US010566672B2

(12) United States Patent
Elsherbini et al.

(10) Patent No.: US 10,566,672 B2
(45) Date of Patent: Feb. 18, 2020

(54) WAVEGUIDE CONNECTOR WITH TAPERED SLOT LAUNCHER

(71) Applicant: INTEL CORPORATION, Santa Clara, CA (US)

(72) Inventors: Adel A. Elsherbini, Chandler, AZ (US); Sasha N. Oster, Chandler, AZ (US); Johanna M. Swan, Scottsdale, AZ (US); Georgios C. Dogiamis, Chandler, AZ (US); Shawna M. Liff, Scottsdale, AZ (US); Aleksandar Aleksov, Chandler, AZ (US); Telesphor Kamgaing, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 257 days.

(21) Appl. No.: 15/277,504

(22) Filed: Sep. 27, 2016

(65) Prior Publication Data

US 2018/0090848 A1 Mar. 29, 2018

(51) Int. Cl.
*H01P 5/10* (2006.01)
*H01Q 13/08* (2006.01)

(52) U.S. Cl.
CPC ..... *H01P 5/10* (2013.01)

(58) Field of Classification Search
CPC . H01P 5/10; H01P 5/1007; H01L 3/10; H01L 21/064

(Continued)

(56) References Cited

U.S. PATENT DOCUMENTS 4,853,704 A * 8/1989 Diaz ..... H01Q 13/085 343/767
4,882,553 A * 11/1989 Davies ..... H01P 5/1007 333/26

(Continued)

FOREIGN PATENT DOCUMENTS

EP 0257881 A2 3/1998
JP 2007235563 A1 9/2007

(Continued)

OTHER PUBLICATIONS

Unpublished—PCT Application No. PCT/US2016/054900, filed Sep. 30, 2016.

(Continued)

*Primary Examiner* — Dean O Takaoka
(74) *Attorney, Agent, or Firm* — Grossman, Tucker, Perreault & Pfleger, PLLC

(57) ABSTRACT

The systems and methods described herein provide a traveling wave launcher system physically and communicably coupled to a semiconductor package and to a waveguide connector. The traveling wave launcher system includes a slot-line signal converter and a tapered slot launcher. The slot-line signal converter may be formed integral with the semiconductor package and includes a balun structure that converts the microstrip signal to a slot-line signal. The tapered slot launcher is communicably coupled to the slot-line signal converter and includes a planar first member and a planar second member that form a slot. The tapered slot launcher converts the slot-line signal to a traveling wave signal that is propagated to the waveguide connector.

19 Claims, 18 Drawing Sheets

(58) Field of Classification Search
USPC ..... 333/26; 343/767, 770
See application file for complete search history.

(56) References Cited

U.S. PATENT DOCUMENTS

| | | | | |
|---|---|---|---|---|
| 5,036,335 | A * | 7/1991 | Jairam | H01Q 13/085 343/767 |
| 5,264,860 | A * | 11/1993 | Quan | H01Q 13/085 343/767 |
| 5,545,924 | A | 8/1996 | Contolatis et al. | |
| 5,557,291 | A | 9/1996 | Chu et al. | |
| 5,825,333 | A * | 10/1998 | Kudoh | H01Q 1/247 343/781 R |
| 6,292,153 | B1 * | 9/2001 | Aiello | H01Q 13/085 343/767 |
| 6,317,094 | B1 | 11/2001 | Wu et al. | |
| 6,538,614 | B2 * | 3/2003 | Fleming | H01Q 9/045 343/767 |
| 6,867,742 | B1 * | 3/2005 | Irion, II | H01Q 13/085 343/767 |
| 7,057,570 | B2 | 6/2006 | Irion, II | |
| 7,471,165 | B2 * | 12/2008 | Asamura | H01P 5/10 333/246 |
| 7,652,631 | B2 * | 1/2010 | McGrath | H01Q 1/38 343/767 |
| 9,142,889 | B2 * | 9/2015 | Pazin | H01Q 13/106 |
| 2002/0186105 | A1 | 12/2002 | Shih et al. | |
| 2003/0137465 | A1 | 9/2003 | Graczyk et al. | |
| 2003/0169965 | A1 | 9/2003 | Handa | |
| 2003/0197572 | A1 | 10/2003 | Ammar | |
| 2005/0012199 | A1 | 1/2005 | Rosenau et al. | |
| 2005/0012672 | A1 | 1/2005 | Fisher | |
| 2007/0031083 | A1 | 2/2007 | Logvin et al. | |
| 2008/0211726 | A1 | 9/2008 | Elsallal et al. | |
| 2008/0224936 | A1 | 9/2008 | Brist et al. | |
| 2010/0053026 | A1 | 3/2010 | Van Der Poel | |
| 2010/0302544 | A1 | 12/2010 | Duer | |
| 2011/0018657 | A1 | 1/2011 | Cheng et al. | |
| 2011/0102284 | A1 | 5/2011 | Braown et al. | |
| 2011/0267249 | A1 | 11/2011 | Miyata | |
| 2012/0176285 | A1 | 7/2012 | Morgia | |
| 2013/0082800 | A1 | 4/2013 | Rofougaran et al. | |
| 2013/0120206 | A1 | 5/2013 | Biancotto et al. | |
| 2014/0085156 | A1 | 3/2014 | Gebretnsae et al. | |
| 2014/0218251 | A1 * | 8/2014 | Waschenko | H01Q 13/10 343/770 |
| 2014/0291835 | A1 | 10/2014 | Demin et al. | |
| 2015/0029069 | A1 | 1/2015 | Roemer et al. | |
| 2015/0048471 | A1 | 2/2015 | Hasch et al. | |
| 2015/0260916 | A1 | 9/2015 | Cherchi et al. | |
| 2016/0043455 | A1 | 2/2016 | Seler et al. | |
| 2016/0153040 | A1 | 6/2016 | Zhong et al. | |
| 2017/0324135 | A1 | 11/2017 | Blech et al. | |
| 2018/0090803 | A1 * | 3/2018 | Elsherbini | H01P 11/00 |

FOREIGN PATENT DOCUMENTS

| | | | |
|---|---|---|---|
| WO | 2018057002 | A1 | 3/2018 |
| WO | 2018057006 | A1 | 3/2018 |
| WO | 2018063238 | A1 | 4/2018 |
| WO | 2018063367 | A1 | 4/2018 |

OTHER PUBLICATIONS

Unpublished—U.S. Appl. No. 15/280,823, filed Sep. 29, 2016.
Unpublished—PCT Application No. PCT/US2016/053491, filed Sep. 23, 2016.
Unpublished—PCT Application No. PCT/US2016/053463, filed Sep. 23, 2016.
Unpublished—PCT Application No. PCT/US2016/054417, filed Sep. 29, 2016.
Unpublished—PCT Application No. PCT/US2016/054977, filed Sep. 30, 2016.
Unpublished—PCT Application No. PCT/US2016/054832, filed Sep. 30, 2016.
Unpublished—PCT Application No. PCT/US2016/054888, filed Sep. 30, 2016.
Unpublished—PCT Application No. PCT/US2016/054837, filed Sep. 30, 2016.
Unpublished—U.S. Appl. No. 15/282,050, filed Sep. 30, 2016.
Unpublished—U.S. Appl. No. 15/282,086, filed Sep. 30, 2016.
International Search Report and Written Opinion issued in PCT/US2017/049173, dated Dec. 11, 2017, 13 pages.
International Search Report and Written Opinion issued in PCT/US2017/048755, dated Dec. 14, 2017, 10 pages.
Notice of Allowance received in U.S. Appl. No. 15/280,823, dated Nov. 19, 2018, 16 pages.
International Search Report received for PCT Application No. PCT/US2016/053491, dated Apr. 25, 2017, 10 pages.
International Search Report received for PCT Application No. PCT/US2016/054417, dated Jun. 20, 2017, 8 pages.
International Search Report received for PCT Application No. PCT/US2016/054900, dated Apr. 25, 2017, 11 pages.
International Search Report received for PCT Application No. PCT/US2016/053463, dated Apr. 25, 2017, 12 pages.
Office Action received in U.S. Appl. No. 15/280,823 dated Jun. 14, 2018, 18 pages.

* cited by examiner

WAVEGUIDE CONNECTOR WITH TAPERED SLOT LAUNCHER

TECHNICAL FIELD

The present disclosure relates to semiconductor package mounted slot launchers used with microwave waveguides.

BACKGROUND

As more devices become interconnected and users consume more data, the demand placed on servers accessed by users has grown commensurately and shows no signs of letting up in the near future. Among others, these demands include increased data transfer rates, switching architectures that require longer interconnects, and extremely cost and power competitive solutions.

There are many interconnects within server and high performance computing (HPC) architectures today. These interconnects include within blade interconnects, within rack interconnects, and rack-to-rack or rack-to-switch interconnects. In today's architectures, short interconnects (for example, within rack interconnects and some rack-to-rack) interconnects are achieved with electrical cables—such as Ethernet cables, co-axial cables, or twin-axial cables, depending on the required data rate. For longer distances, optical solutions are employed due to the very long reach and high bandwidth enabled by fiber optic solutions. However, as new architectures emerge, such as 100 Gigabit Ethernet, traditional electrical connections are becoming increasingly expensive and power hungry to support the required data rates. For example, to extend the reach of a cable or the given bandwidth on a cable, higher quality cables may need to be used or advanced equalization, modulation, and/or data correction techniques employed which add power and latency to the system. For some distances and data rates required in proposed architectures, there is no viable electrical solution today. Optical transmission over fiber is capable of supporting the required data rates and distances, but at a severe power and cost penalty, especially for short to medium distances, such as a few meters.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1A:
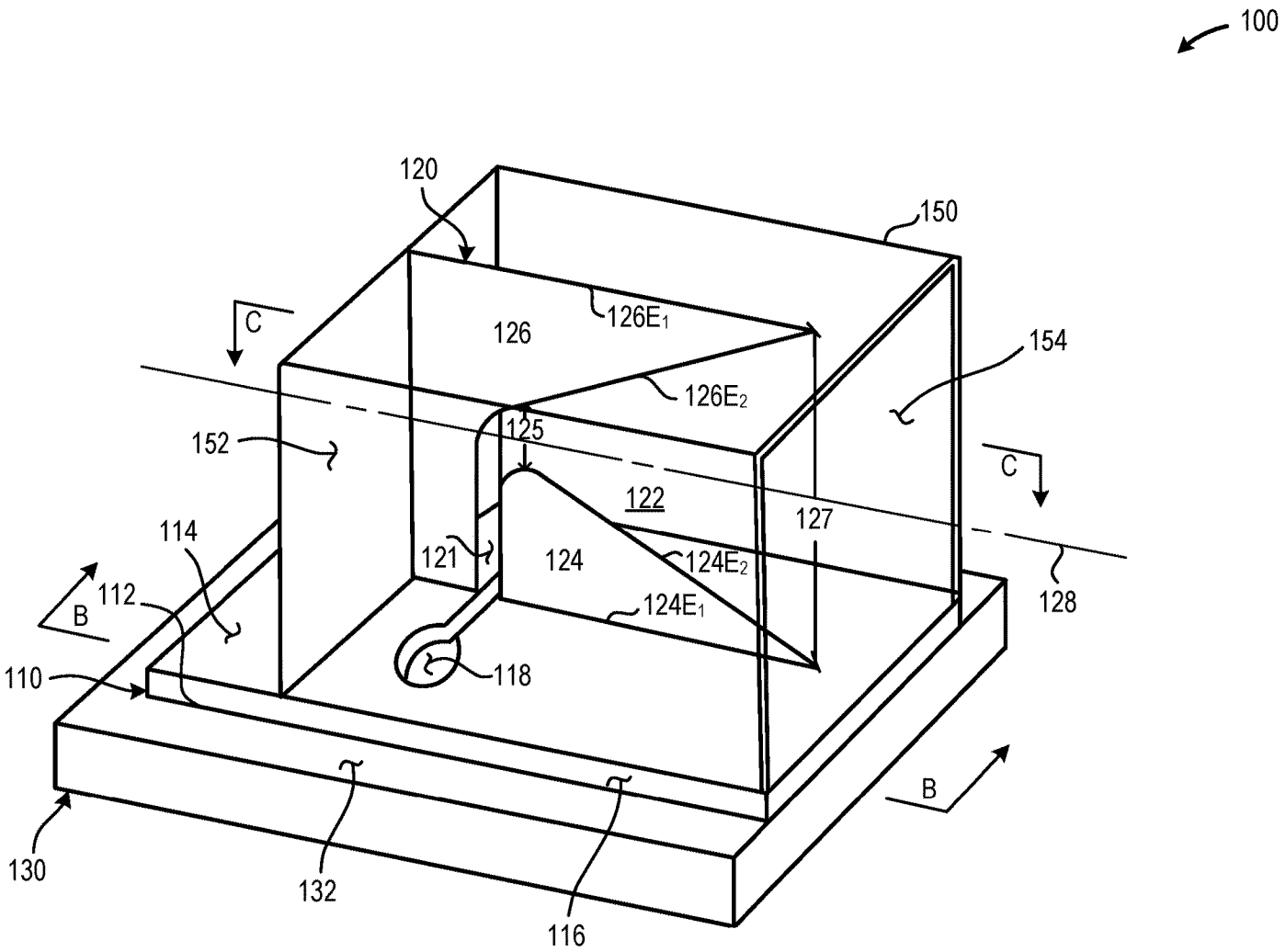
FIG. 1A provides a perspective view of an illustrative traveling wave launcher system that includes a slot-line signal converter coupled to a tapered slot launcher, the traveling wave launcher system is communicably coupled to a semiconductor package and physically coupled to an external surface of the semiconductor package, in accordance with at least one embodiment described herein.

Although the following Detailed Description will proceed with reference being made to illustrative embodiments, many alternatives, modifications and variations thereof will be apparent to those skilled in the art.

DETAILED DESCRIPTION

As data transfer speeds continue to increase, cost efficient and power competitive solutions are needed for communication between blades installed in a rack and between nearby racks. Such distances typically range from less than 1 meter to about 10 meters. The systems and methods disclosed herein use millimeter-wave transceivers paired with waveguides to communicate data between blades and/or racks at transfer rates in excess of 25 gigabits per second (Gbps). The millimeter wave antennas used to transfer data may be formed and/or positioned in, on, or about the semiconductor package. A significant challenge exists in aligning the millimeter-wave antenna with the waveguide member to maximize the energy transfer from the millimeter-wave antenna to the waveguide member. Further difficulties may arise when one realizes the wide variety of available waveguide members. Although metallic and metal coated waveguide members are prevalent, such waveguide members may include rectangular, circular, polygonal, oval, and other shapes. Such waveguide members may include hollow members, members having a conductive and/or non-conductive internal structure, and hollow members partially or completely filled with a dielectric material.

Ideally, a waveguide is coupled to a semiconductor package in a location that maximizes the energy transfer between the millimeter-wave launcher and the waveguide. Such positioning however, is often complicated by the shape and/or configuration of the waveguide itself, the relatively small dimensions associated with the waveguide (e.g., 2 millimeters or less), the relatively tight tolerances required to maximize energy transfer (e.g., 10 micrometers or less), and precisely positioning the waveguide proximate a millimeter-wave launcher that is potentially hidden beneath the surface of the semiconductor package. The systems and methods described herein provide new, novel, and innovative systems and methods for positioning and coupling waveguides to semiconductor packages such that energy transfer from the millimeter-wave launcher to the waveguide is improved over current patch and stacked patch emitter designs. The systems and methods described herein provide new, novel, and innovative systems and methods for positioning and coupling waveguides to semiconductor packages such that the system bandwidth is increased over more traditional patch and stacked patch launcher designs.

The system and methods disclosed herein employ new launcher and waveguide connector architecture for exciting waveguides coupled to a semiconductor package. Existing semiconductor package mounted launchers include a patch or stacked patch structure electrically coupled to the waveguide walls. Such "patch" or "stacked patch" installations suffer from limited bandwidth for thin semiconductor package substrates, and consequently employ the use of relatively thick semiconductor package substrates. Such thick semiconductor package substrates may cause manufacturing and assembly limitations. In addition, such waveguide/semiconductor package patch systems are sensitive to waveguide alignment and conductive coupling to the signal generator in the semiconductor package.

The systems and methods described herein employ a different type of excitation structure, a tapered slot launcher that is compatible with and may be incorporated into conventional printed circuit board manufacturing processes. The tapered slot launchers described herein include a tapered slot launcher that includes coplanar, spaced-apart, first and second planar members that together form the tapered slot launcher. This vertical tapered slot launcher may be incorporated into a waveguide such that when the waveguide is conductively coupled to a semiconductor substrate, the tapered slot launcher aligns with a balun structure in a slot-line signal converter disposed on the surface of the semiconductor package.

The tapered slot launcher converts the slot-line signal provided by the slot-line signal converter to a closed waveguide type signal. Closed waveguide mode signals beneficially provide wider bandwidth and greater energy efficiency over patch and stacked patch launchers. Such tapered slot launchers may be beneficially combined to provide space saving two-dimensional and three-dimensional waveguide arrays—a significant advantage in the confines of a typical rack environment. Such tapered slot launchers are also less sensitive to manufacturing tolerances. Compared to patch or stacked patch launchers, the systems and methods described herein beneficially provide increased bandwidth in a thinner semiconductor package.

In embodiments, the systems and methods herein convert a signal transmitted along a microstrip feed line to a slot-line mode using a balun structure disposed proximate an external surface of a semiconductor package. The balun structure may include a double-lobed balun structure. The slot-line mode signal is translated to a direction perpendicular to the semiconductor package and propagates through a tapered slot which converts the signal to a closed waveguide mode. Beneficially, the systems and methods described herein may be adapted to dielectric waveguides through the use of 180 degree opposed slot launchers and may also be adapted to various waveguide geometries by adjusting the shape of the outline on the semiconductor package to match the geometry of the waveguide.

A microwave waveguide connector and slot launcher apparatus is provided. The apparatus includes a slot line signal converter and a tapered slot launcher. The slot-line signal converter may include a first electrically conductive member communicably coupleable to a semiconductor package; a planar second electrically conductive member conductively coupled to the first electrically conductive member, at least a portion of the second electrically conductive member communicably coupleable to a waveguide member; and a balun structure to convert a signal to a slot-line signal. The tapered slot launcher may include a tapered slot launcher to emit a traveling wave signal having an axis of propagation parallel to the plane of the second electrically conductive member, the tapered slot launcher including a first member and a second member; wherein the first member and the second member include spaced apart coplanar members that form an open-ended, tapered slot co-aligned with the axis of propagation of the traveling wave signal; wherein the first member communicably couples to the second electrically conductive member at a first location proximate the balun structure; and wherein the second member communicably couples to the second electrically conductive member at a second location proximate the balun structure.

A co-planar tapered slot launcher traveling wave transmission method is provided. The method may include providing a signal to a slot line signal converter communicably coupled to a semiconductor package and physically coupled to an external surface of the semiconductor package; converting the signal to a slot line signal, via a balun structure formed at least partially in the slot line signal converter; and converting the slot-line signal to a closed waveguide mode signal via a tapered slot launcher that includes a first member and a second member, the first member and the second member including spaced apart co-planar members that form an open-ended, tapered slot co-aligned with an axis of propagation of the traveling wave signal.

A tapered slot launcher traveling wave transmission system is provided. The system may include a means for providing a signal to a slot line signal converter communicably coupled to a semiconductor package and physically coupled to an external surface of the semiconductor package; a means for converting the signal to a slot line signal, via a balun structure formed at least partially in the slot line signal converter; and a means for converting the slot-line signal to a closed waveguide mode signal via a tapered slot launcher that includes a first member and a second member, the first member and the second member including spaced apart co-planar members that form an open-ended, tapered slot co-aligned with an axis of propagation of the traveling wave signal.

A microwave transmission system is provided. The system may include a semiconductor package that includes a radio frequency (RF) signal producing die; a waveguide connector; a slot line signal converter and a tapered slot launcher. The slot-line signal converter may include: a first electrically conductive member communicably coupleable to a semiconductor package; a planar second electrically conductive member conductively coupled to the first electrically conductive member, at least a portion of the second electrically conductive member communicably coupleable to a waveguide member; and a balun structure to convert a signal to a slot-line signal. The tapered slot launcher may emit a traveling wave signal having an axis of propagation parallel to the plane of the second electrically conductive member. The tapered slot launcher may include: a first member and a second member; wherein the first member and the second member include spaced apart coplanar members that form an open-ended, tapered slot co-aligned with the axis of propagation of the traveling wave signal; wherein the first member communicably couples to the second electrically conductive member at a first location proximate the balun structure; and wherein the second member communicably couples to the second electrically conductive member at a second location proximate the balun structure.

A tapered slot launcher manufacturing method is provided. The method may include communicably coupling a connection point on a semiconductor package to a first electrically conductive member of a slot-line signal converter, the connection point to provide at least one radio frequency (RF) signal to the slot-line signal converter proximate a balun structure formed in the slot-line signal converter; physically coupling the first electrically conductive member to at least a portion of the semiconductor package; affixing at least a portion of a tapered slot launcher inside a waveguide connector, the tapered slot launcher comprising a planar first member and planar second member, the first member including at least one edge forming at least a portion of a tapered slot; and communicably coupling the waveguide connector and the tapered slot launcher to a second electrically conductive member of the slot-line signal converter, the second electrically conductive member conductively coupled to the first electrically conductive member; wherein the first member operably couples to the second electrically conductive member at a first location proximate the balun structure; and wherein the planar second member operably coupled to the second electrically conductive member at a second location proximate the balun structure, the second location disposed on an opposite side of the balun structure from the first location.

Figure 1B:
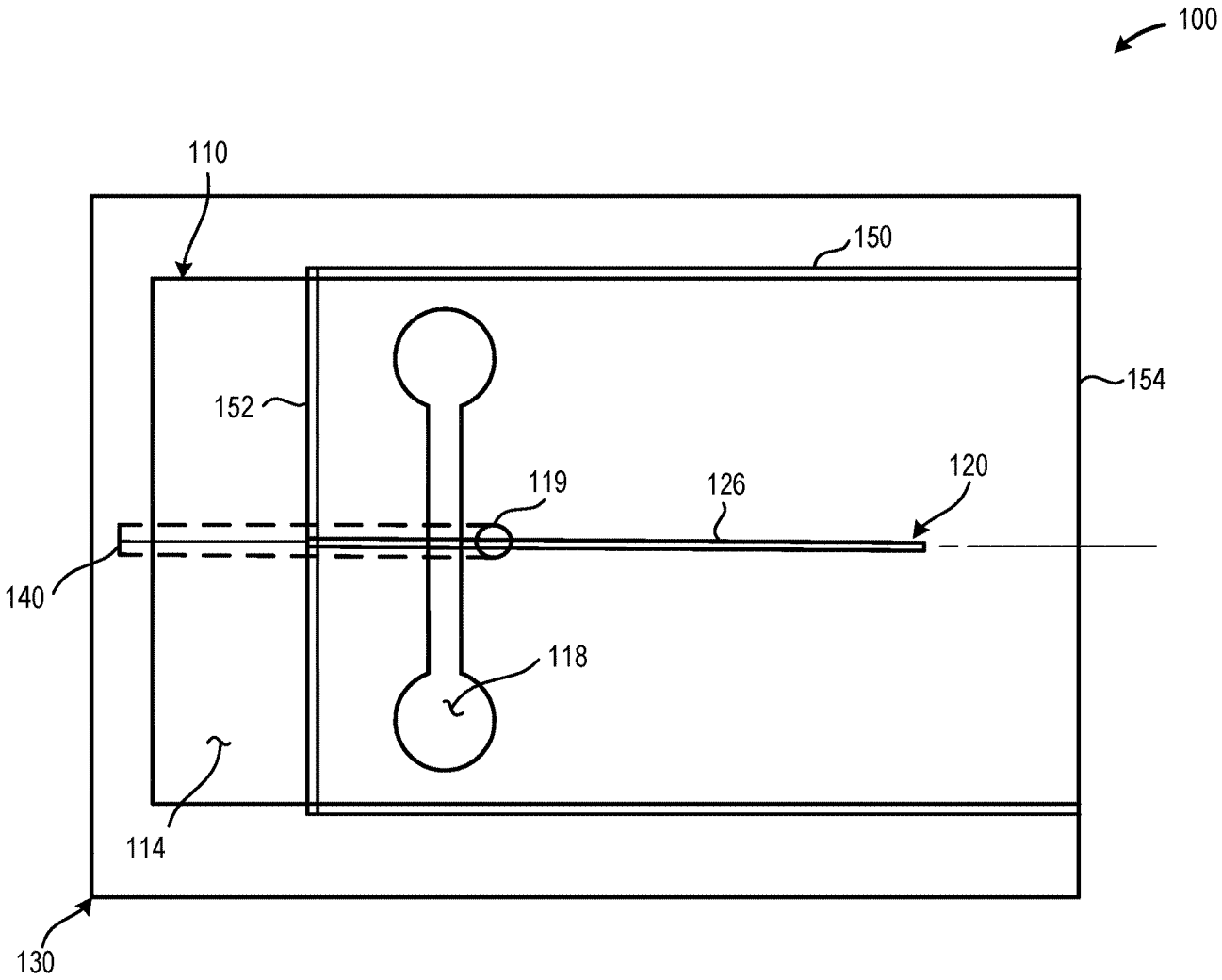
FIG. 1B provides a horizontal cross-sectional view of the illustrative traveling wave launcher system depicted in FIG. 1A, in accordance with at least one embodiment described herein.
Figure 1C:
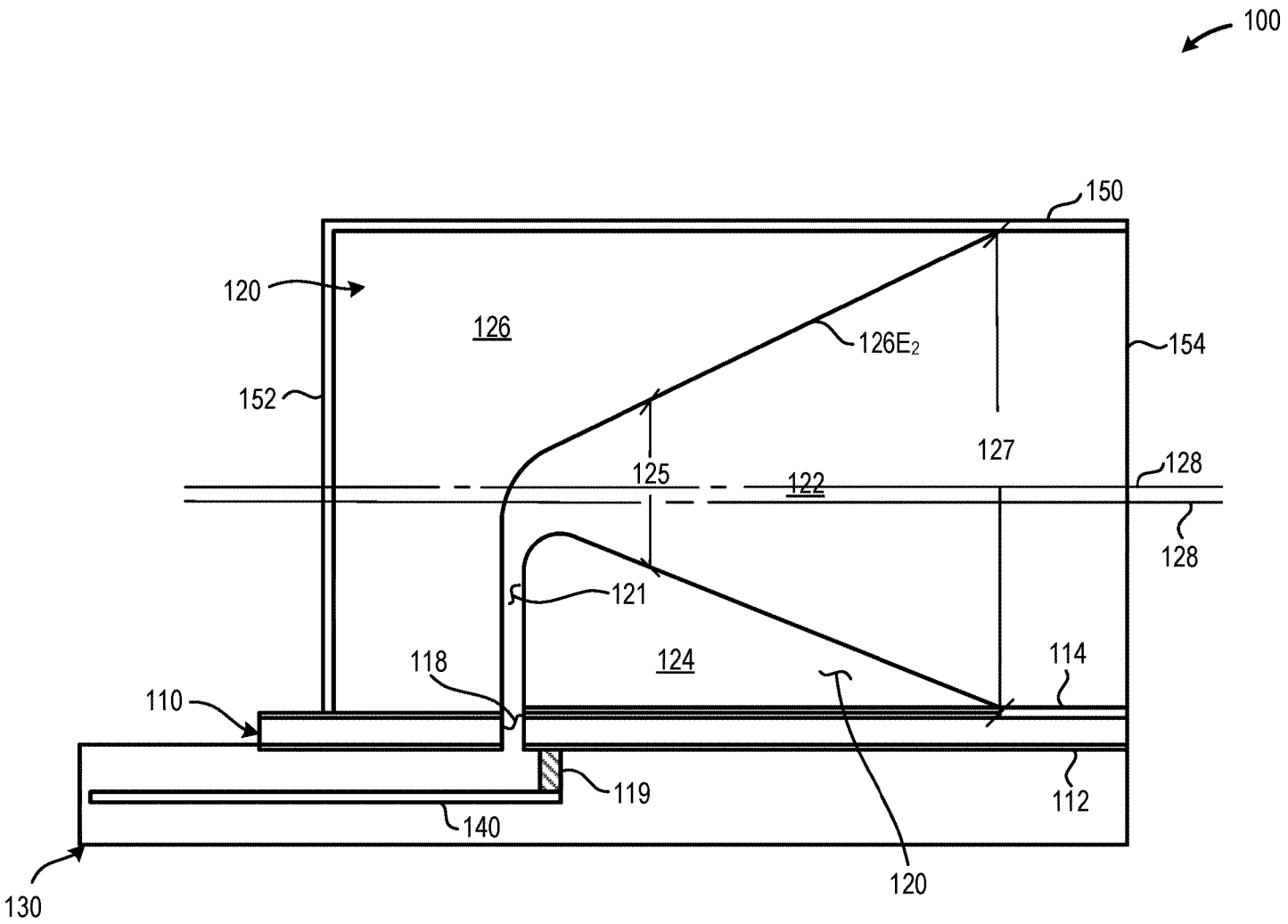
FIG. 1C provides a vertical cross-sectional view of the illustrative traveling wave launcher system depicted in FIG. 1A, in accordance with at least one embodiment described herein.

FIG. 1A provides a perspective view of an illustrative traveling wave launcher system 100 that includes a slot-line signal converter 110 coupled to a tapered slot launcher 120, the traveling wave launcher system 100 is communicably coupled to a semiconductor package and physically coupled to an external surface 132 of the semiconductor package 130, in accordance with at least one embodiment described herein. FIG. 1B provides a horizontal cross-sectional view of the illustrative traveling wave launcher system 100 depicted in FIG. 1A, in accordance with at least one embodiment described herein. FIG. 1C provides a vertical cross-sectional view of the illustrative traveling wave launcher system 100 depicted in FIG. 1A, in accordance with at least one embodiment described herein.

As depicted in FIG. 1A, the slot-line signal converter 110 includes a first electrically conductive member 112 and a second electrically conductive member 114 that are communicably coupled together. The first electrically conductive member 112 may be disposed in, on, or about at least a portion of an exterior surface 132 of the semiconductor package 130. The first electrically conductive member 112 is physically coupled or otherwise affixed to the exterior surface 132 of the semiconductor package 130. The first electrically conductive member 112 is also communicably coupled to one or more systems, structures, or devices disposed in, on, or about the semiconductor package 130.

The slot-line signal converter 110 includes a balun structure 118 to convert a signal received from a source to a slot-line signal. In embodiments, the balun structure 118 may include a dumbbell-shaped, double-lobed, balun structure 118. The first electrically conductive member 112 includes a balun structure having a first physical configuration and the second electrically conductive member 114 includes a balun structure having a second physical configuration. In some instances, the balun structure in the first electrically conductive member 112 may be the same as the balun structure in the second electrically conductive member 114. In some instances, the balun structure in the first electrically conductive member 112 may be different than the balun structure in the second electrically conductive member 114.

The second electrically conductive member 114 is communicably coupled to the tapered slot launcher 120. As depicted in FIG. 1A, the tapered slot launcher 120 includes two coplanar members a first member 124 that physically and/or communicably couples to the second electrically conductive member 114 at a first location and a second member 126 that also physically and/or communicably couples to the second electrically conductive member 114 at a second location. In embodiments, a planar first member 124 and a planar second member 126 are disposed co-planarly in a spaced arrangement to form a feed channel 121 and a tapered slot 122. In embodiments, the first member 124 may be physically and/or conductively coupled to the second electrically conductive member 114 at a first location with respect to the balun structure and the second member 126 may be physically and/or conductively coupled to the second electrically conductive member 114 at a second location with respect to the balun structure 118. In such embodiments the first location and the second location may be disposed in opposition across (e.g., on opposite sides of) the balun structure 118.

The first member 124 and the second member 126 may be planar members that are disposed co-planar to each other (i.e., the first member 124 and the second member 126 may lay or otherwise fall in the same plane). The first edge 124$E_1$ of the first member 124 may be disposed proximate the second electrically conductive member 114. The first edge 124$E_1$ of the first member 124 may be physically and/or conductively coupled to the second electrically conductive member 114. The second edge 124$E_2$ of the first member 124 may form at least a portion of a border, boundary, or periphery of the tapered slot 122. The first edge 126$E_1$ of the second member 126 may be disposed proximate the waveguide connector 150. The first edge 126$E_1$ of the second member 126 may be physically and/or conductively coupled to the waveguide connector 150. The second edge 126$E_2$ of the second member 126 may form at least a portion of a border, boundary, or periphery of the tapered slot 122.

A microstrip feedline 140 provides the signal to the balun structure 118. A connection 119 communicably couples the microstrip feedline 140 to the balun structure 118. The two lobes of the balun structure 118 produce an impedance matched slot-line signal. The tapered slot launcher 122 converts the slot-line signal produced by the balun structure 118 to a closed waveguide mode signal (e.g., a TE10 signal for an operably coupled rectangular waveguide) that propagates along a waveguide operably coupled to the tapered slot launcher 120 via the waveguide connector 150. The traveling-wave signal propagates along channel 121 and is emitted by the tapered slot launcher 120. The traveling wave signal propagates along a waveguide operably coupled to the tapered slot launcher 120 via the waveguide connector 150.

The slot-line signal converter 110 converts the microstrip signal to a slot-line signal. The microstrip signal may, in some implementations, be generated or otherwise created and supplied to the microstrip to slot-line signal converter 110 by one or more components such as a mm-wave die disposed in or communicably coupled to the semiconductor package 130. In embodiments, the microstrip signal includes a signal at a microwave frequency of from about 30 GHz to about 300 GHz; about 30 GHz to about 200 GHz; or about 30 GHz to 100 GHz. Other signal frequencies may be used to equal effect.

The slot-line signal converter 110 includes a first electrically conductive member 112 disposed proximate at least a portion of an external surface 132 of the semiconductor package 130 and a second electrically conductive member 114 disposed proximate the tapered slot launcher 120. In embodiments, the first electrically conductive member 112 and the second electrically conductive member 114 may include two different electrically conductive members that are physically and/or conductively coupled 116 using solder, an electrically conductive adhesive, or similar. In other embodiments (not depicted in FIGS. 1A-1C), the upper surface of a single, electrically conductive, member provides all or a portion of the first electrically conductive member 112 and the lower surface of the single, electrically conductive member provides all or a portion of the second electrically conductive member 114.

The first electrically conductive member 112 and the second electrically conductive member 114 may be of any shape, size, or configuration. In embodiments, the first electrically conductive member 112 may be formed, patterned, or otherwise disposed on the external surface 132 of the semiconductor package 130. In other embodiments, the first electrically conductive member 112 may be conductively and/or physically coupled to one or more electrical contacts (e.g., vias, pads, lands, or similar electrically conductive structures) disposed on an external surface 132 of the semiconductor package 130. In such embodiments, the first electrically conductive member 112 may be physically and conductively coupled to one or more electrical contacts via solder, an electrically conductive adhesive, or similar electrically conductive bonding or affixation systems and methods.

In embodiments, the second electrically conductive member 114 may be formed integrally with all or a portion of the tapered slot launcher 120. In other embodiments, the second electrically conductive member 114 may be formed separate from the tapered slot launcher 120 and the tapered slot launcher 120 may be physically and/or conductively coupled to the second electrically conductive member 114. In yet other embodiments, all or a portion of the second electrically conductive member 114 may be formed integral with the waveguide connector 150. Forming the tapered slot launcher 120 integral with the second electrically conductive member 114 beneficially aligns the tapered slot launcher 120 with the second electrically conductive member 114 and, consequently, with the waveguide connector 150 when the waveguide connector 150 is conductively coupled to the second electrically conductive member 114.

The slot-line signal converter 110 converts the received microstrip signal to a slot-line mode signal (i.e., two impedance matched signals) using the balun structure 118. The balun structure 118 may include a double-lobed or barbell-type balun structure 118 such as that depicted in FIGS. 1A-1C. The microstrip signal is fed to the balun structure 118 receives the input microstrip signal at a central location on the structure, such as a connection point 119. The open spaces in the balun structure 118 provide an impedance matched slot line signal that is communicated to the communicably coupled slot-line signal converter 110. In implementations, where the slot-line signal converter 110 includes a single member that provides the first electrically conductive member 112 and the second electrically conductive member 114, the balun structure 118 may be symmetric across the thickness of the slot-line signal converter 110 (i.e., the physical configuration of the balun structure 118 on the first electrically conductive member 112 and the second electrically conductive member 114 will be identical). In implementations where the slot-line signal converter 110 includes separate first electrically conductive member 112 and second electrically conductive member 114, the balun structure 118 may be asymmetric across the thickness of the slot-line signal converter 110 (i.e., the physical configuration of the balun structure 118 on the first electrically conductive member 112 and the second electrically conductive member 114 may be different).

The balun structure 118 may include a double lobed structure having symmetric or asymmetric lobes with any physical configuration. Thus, the lobes forming the balun structure 118 may be semi-circular, circular, semi-oval, oval, semi-polygonal, polygonal, etc. The physical dimensions and/or configuration of the lobes forming the balun structure 118 may be based in whole or in part on the operating frequency and/or frequency range of the microstrip signal supplied to the microstrip to slot-line signal converter 110.

The tapered slot launcher 120 transitions the axis of propagation of the slot-line mode signal provided by the balun structure 119 to different axis of propagation 128 and converts the signal to the closed waveguide mode signal. In some implementations, the axis of propagation 128 of the closed waveguide mode signal may be parallel to the external surface of the semiconductor package 130. In some implementations, the axis of propagation 128 of the closed waveguide mode signal may be aligned with or parallel to a longitudinal axis of the waveguide connector 150 coupled to the traveling wave launcher system 100.

In such embodiments, the second edge 124$E_2$ of the first member 124 and the second edge 126$E_2$ of the second member 126 form a tapered slot 122. The second edge 124$E_2$ of the first member 124 and the second edge 126$E_2$ of the second member 126 may extend at an angle such that at a first end 125 the second edges 124$E_2$ and 126$E_2$ are disposed relatively close to each other and at an opposed second end 127 the second edges 124$E_2$ and 126$E_2$ are disposed relatively distant from each other. In embodiments, the first member 124 and the second member 126 forming the tapered slot launcher 120 are grounded to the ground plane of the semiconductor package 130 via the waveguide connector 150. In other embodiments, the first member 124 and the second member 126 forming the tapered slot launcher 120 may be coupled directly or indirectly to the ground plane of the semiconductor package 130.

In some implementations, the second edge 124$E_2$ of the second plate 124 and/or the second edge 126$E_2$ of the second plate 126 may include a straight edge, a stepped edge, a curved edge, an elliptical edge, or an arcuate edge. The distance between the first plate 124 and the second plate 126 may, in some implementations, be based in whole or in part on the frequency and/or frequency band of the closed waveguide mode signal transmitted by the tapered slot launcher 120.

In some implementations, all or a portion of the first member 124 and/or all or a portion of the second member 126 may be formed integral with the second electrically conductive member 114 forming the slot-line signal converter 110. In embodiments, the first member 124 and the second plate 126 extend at an angle of from about 45° to about 90° from the second electrically conductive member 114, measured with respect to the second electrically conductive member 114. In some implementations, the overall physical dimensions of the first plate 124 and the second plate 126 may be based, in whole or in part, on the frequency or frequency band of the closed waveguide mode signal transmitted by the tapered slot launcher 120.

A waveguide connector 150 may be physically and/or communicably coupled to the second electrically conductive member 114 of the slot-line signal converter 110. In embodiments, the waveguide connector 150 may have a closed or partially closed terminal end 152 and an open end 154 to accommodate the operable coupling of an external waveguide to the waveguide connector 150. The waveguide connector 150 may have any size, shape, physical geometry and/or physical configuration for operably coupling an external waveguide to the tapered slot launcher 120. In embodiments, the waveguide connector 150 may have one or more connection features disposed about all or a portion of the open end 154 of the waveguide connector 150. Such connection features may include, but are not limited to, mechanical latches, friction or resistance fit pillars or similar structures, flared ends, high friction coatings or surface treatments, or combinations thereof. In some implementations, the external waveguide may operably couple to the waveguide connector 150 via solder, a conductive adhesive, or similar conductive bonding agent.

Upon operable coupling of the waveguide connector 150 to the second electrically conductive member 114, the tapered slot launcher 120 extends at least partially into the waveguide connector 150. The closed waveguide mode signal generated by the tapered slot launcher 120 propagates along the waveguide connector 150. Although depicted as a rectangular waveguide connector in FIGS. 1A-1C, the waveguide connector 150 may have any transverse geometric cross section. In embodiments, the second electrically conductive member 114 may be physically configured to match one or more physical aspects (e.g., the perimeter geometry) of the waveguide connector 150. Thus, for example, where the waveguide connector 150 has a round or oval cross-section, the second electrically conductive member 114 may have a physical configuration corresponding to the perimeter of the waveguide connector 150. In embodiments, the waveguide connector 150 may include a hollow, electrically conductive waveguide connector. In embodiments, the waveguide connector 150 may include a solid or hollow dielectric waveguide connector 150. In embodiments, the waveguide connector 150 may be at least partially filled with one or more dielectric materials.

Figure 2A:
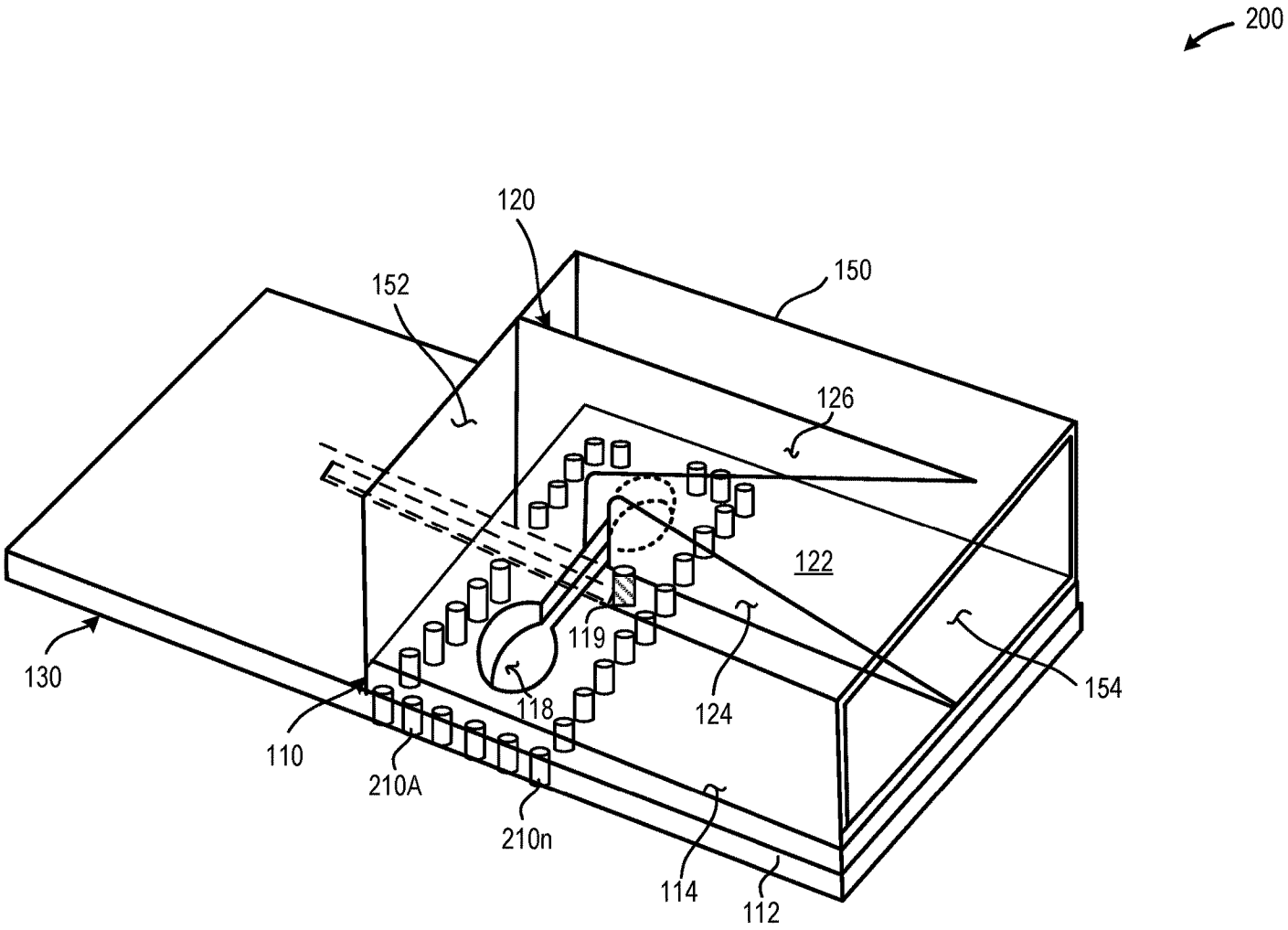
FIG. 2A provides a cut-away perspective view of an illustrative traveling wave launcher system that includes a slot-line signal converter and a tapered slot launcher, in accordance with at least one embodiment described herein.
Figure 2B:
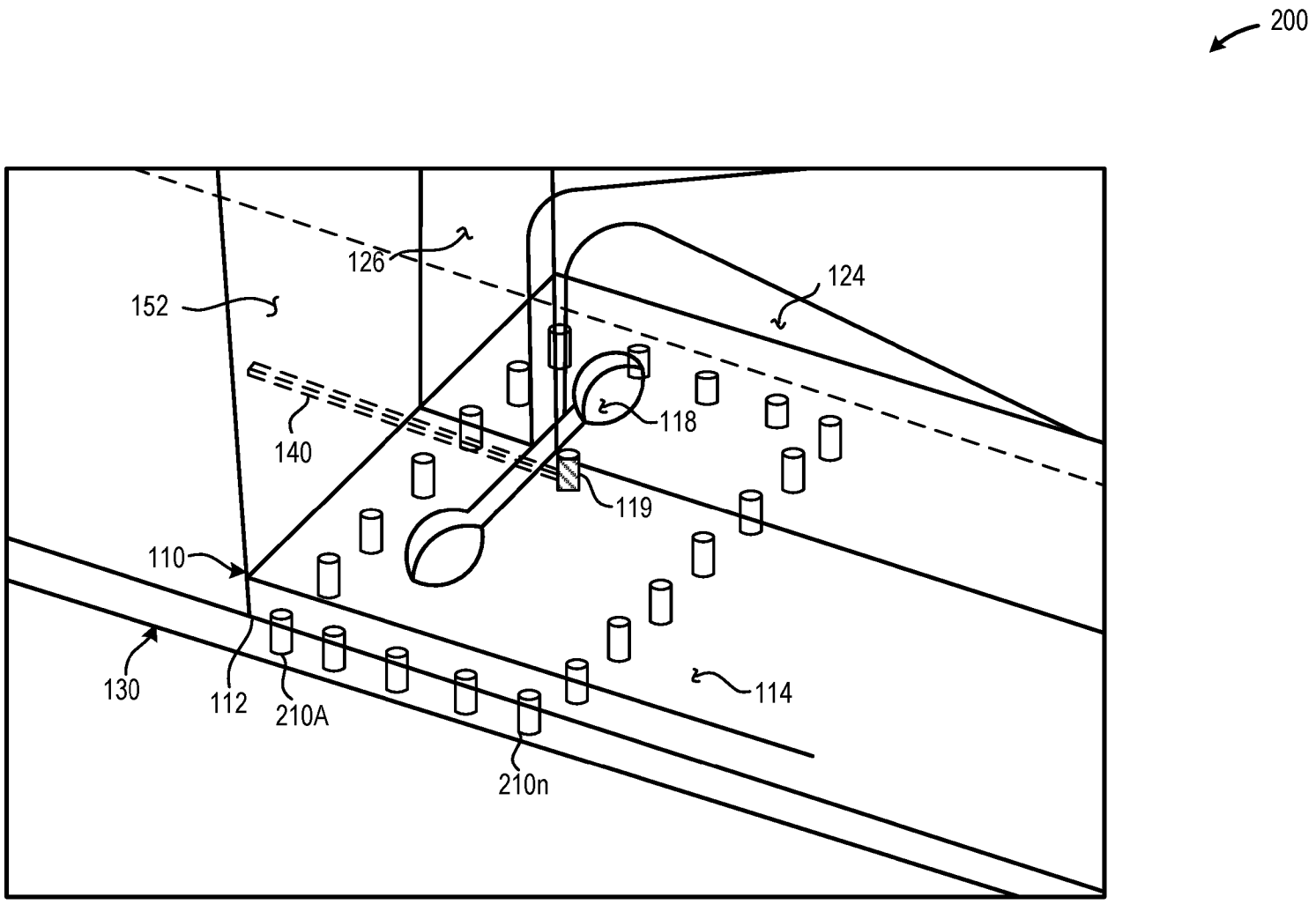
FIG. 2B provides a cut-away perspective detail view of the traveling wave launcher depicted in FIG. 2A and provides additional details showing the microstrip feed and communicable coupling between the microstrip feed and the slot-line signal converter, in accordance with at least one embodiment described herein.

FIG. 2A provides a cut-away perspective view of an illustrative traveling wave launcher system 200 that includes a slot-line signal converter 110 and a tapered slot launcher 120, in accordance with at least one embodiment described herein. As depicted in FIG. 2A, the tapered slot launcher 120 includes a vertically oriented launcher that includes a coplanar arrangement of a first planar member 124 and a second planar member 126. FIG. 2B provides a cut-away perspective detail view of the traveling wave launcher depicted in FIG. 2A and provides additional details showing the microstrip feed 140 and communicable coupling 119 between the microstrip feed and the slot-line signal converter 110, in accordance with at least one embodiment described herein.

As depicted in FIG. 2A, a number of vias **210A-210*n* (collectively, "vias 210") may conductively couple the slot-line signal converter 110 and/or the waveguide connector 150 to a ground plane within the semiconductor package 130. In some implementations, the vias 210 communicably couple to the first electrically conductive member 112 and extend about all or a portion of the perimeter of the slot-line signal converter 110. Although depicted as disposed within the semiconductor package 130, the conductive coupling between the slot-line signal converter 110 and/or the waveguide connector 150 and a ground plane may be performed using one or more conductors external to the semiconductor package 130. The traveling wave launcher system 200 as depicted in FIGS. 2A and 2B is advantageously compatible with standard printed circuit board manufacturing and assembly techniques. The tapered slot launcher 120 used with the traveling wave launcher system 200** is inherently wide band and is beneficially less sensitive to manufacturing tolerances than competitive technologies such as patch launchers or stacked patch launchers.

As depicted in FIG. 2B, a microstrip line signal propagates along a microstrip feed line 140 to the connection point 119. The connection point 119 communicably couples the microstrip feed line 140 to a central location of the balun structure 118. The balun structure 118 converts the signal received via the microstrip feed line 140 to a slot line mode signal. The tapered slot launcher 120 converts the slot-line mode signal to a closed waveguide mode signal that propagates along the axis of propagation 128.

Figure 3A:
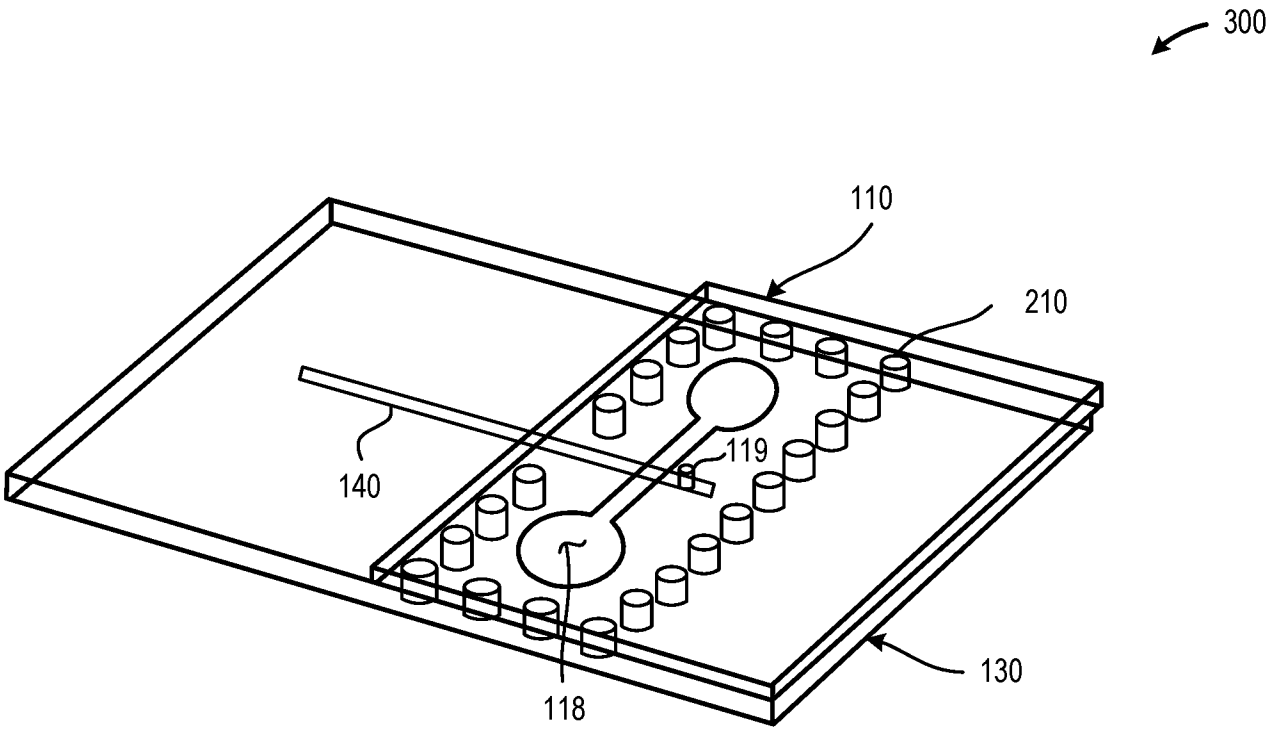
FIG. 3A provides a downward looking perspective view of an illustrative system that includes a semiconductor package operably coupled to a slot-line signal converter, in accordance with at least one embodiment described herein.

FIG. 3A provides a downward looking perspective view of an illustrative system 300 that includes a semiconductor package 130 operably coupled to a slot-line signal converter 110, in accordance with at least one embodiment described herein. Visible in FIG. 3A is the microstrip feed line 140 that, together with connection point 119, communicably couples the balun structure 118 to a signal source, such as a mm-wave die disposed in or otherwise operably coupled to the semiconductor package 130. Also visible in FIG. 3A are the vias 210 that conductively couple the first electrically conductive member 112 to a ground plane disposed in or proximate the semiconductor package 130.

Figure 3B:
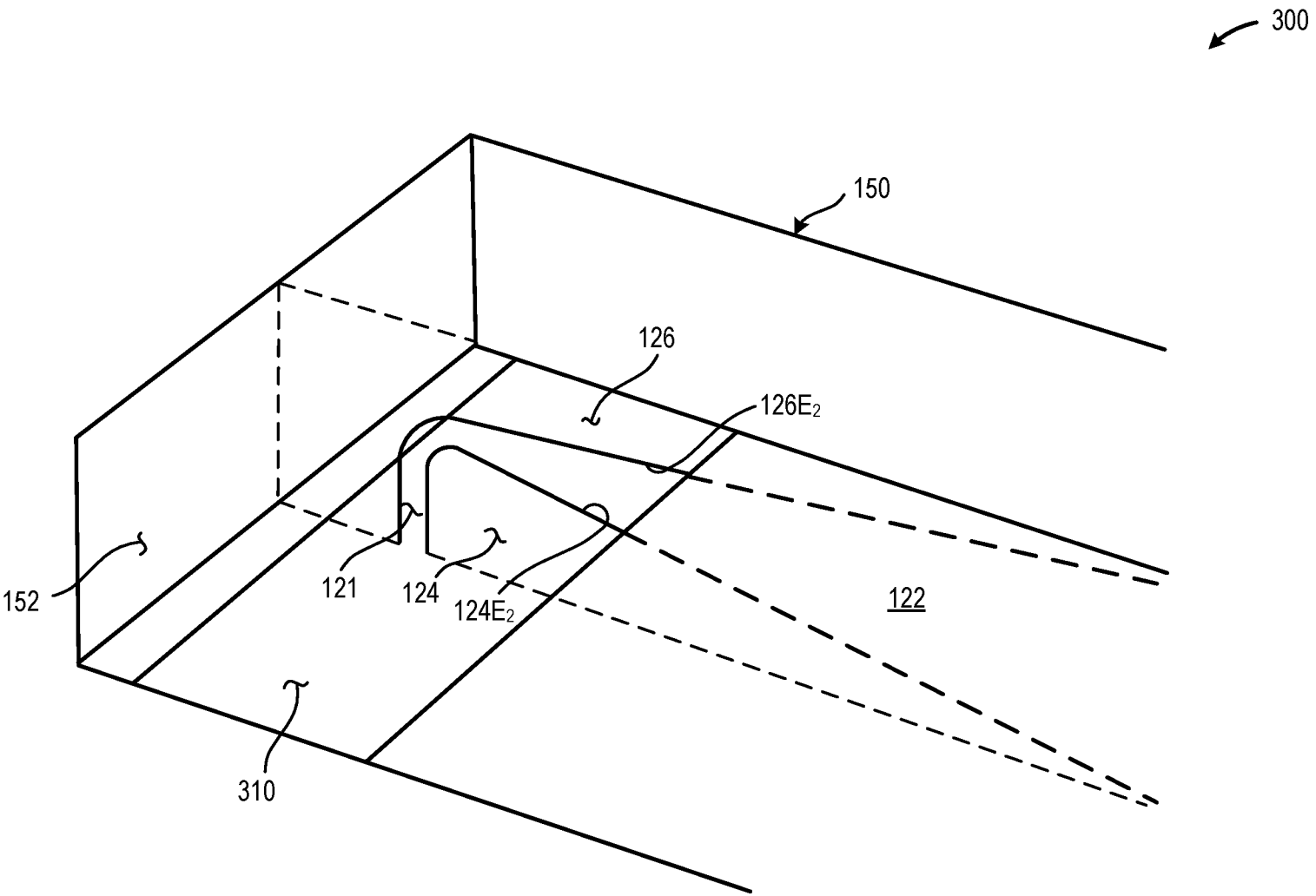
FIG. 3B provides an upward looking perspective view of an illustrative waveguide connector that includes a first member and a second member disposed within the interior of the waveguide connector, in accordance with at least one embodiment described herein.

FIG. 3B provides an upward looking perspective view of an illustrative wave guide 150 that includes a first member 124 and a second member 126 disposed within the hollow interior of the waveguide connector 150, in accordance with at least one embodiment described herein. Visible in FIG. 3B is the aperture 310 that is positioned over the balun structure in the slot-line signal converter 110 when the waveguide connector 150 is positioned on and operably coupled to the slot-line signal converter 110. The aperture 310 is bounded by a perimeter 312. The channel 121 visible between the first member 124 and the second member 126 aligns with the central portion of the barbell-shaped balun structure 118. In some implementations, all or a portion of the tapered slot launcher 120 (e.g., the first member 124 and/or the second member 126) may be formed integral with the waveguide connector 150. In some implementations, all or a portion of the tapered slot launcher 120 e.g., the first member 124 and/or the second member 126) may be formed external to the waveguide connector 150 and affixed in the hollow portion of the waveguide connector 150 using one or more electrically conductive coupling methods, such as soldering and/or one or more electrically conductive adhesives.

Figure 3C:
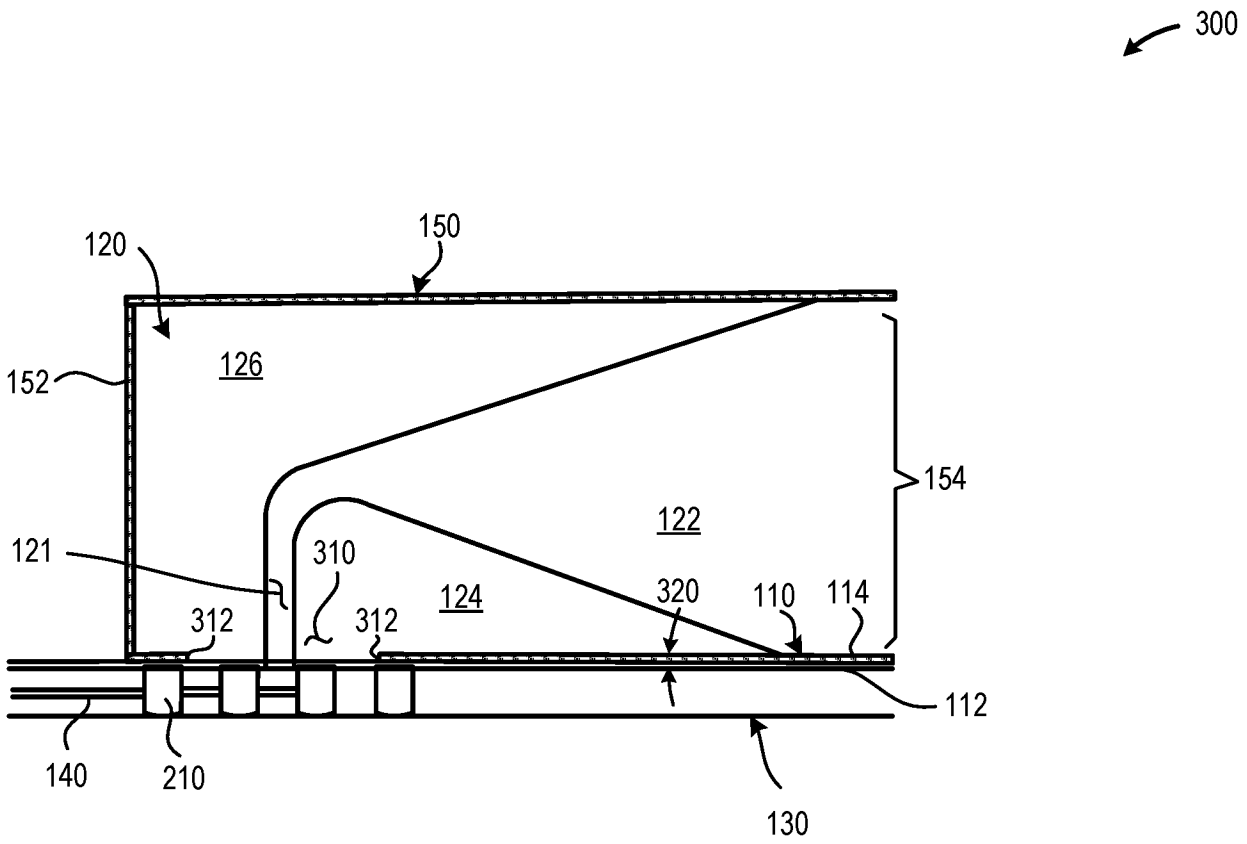
FIG. 3C provides a cross-sectional elevation of a system in which the illustrative waveguide connector depicted in FIG. 3B is shown operably coupled to the illustrative slot-line signal converter depicted in FIG. 3A, in accordance with at least one embodiment described herein.

FIG. 3C provides a cross-sectional elevation of a system 300C in which the illustrative waveguide connector 150 depicted in FIG. 3B is shown operably coupled to the illustrative slot-line signal converter 110 depicted in FIG. 3A, in accordance with at least one embodiment described herein. The waveguide connector 150 may be operably coupled 320 to at least a portion of the second electrically conductive member 114 using one or more electrically conductive affixation methods and/or systems. Illustrative example affixation systems include, but are not limited to, soldering, electrically conductive adhesives, and thermal bonding. As depicted in FIG. 3C, in some implementations, the aperture 310 in the waveguide connector 150 aligns with at least a portion of the grounding vias 210 that are conductively coupled to the first electrically conductive member 112. Also as depicted in FIG. 3C, in implementations, some or all of the balun structure 116 is disposed within the perimeter 312 about some or all of the aperture 310.

Figure 4:
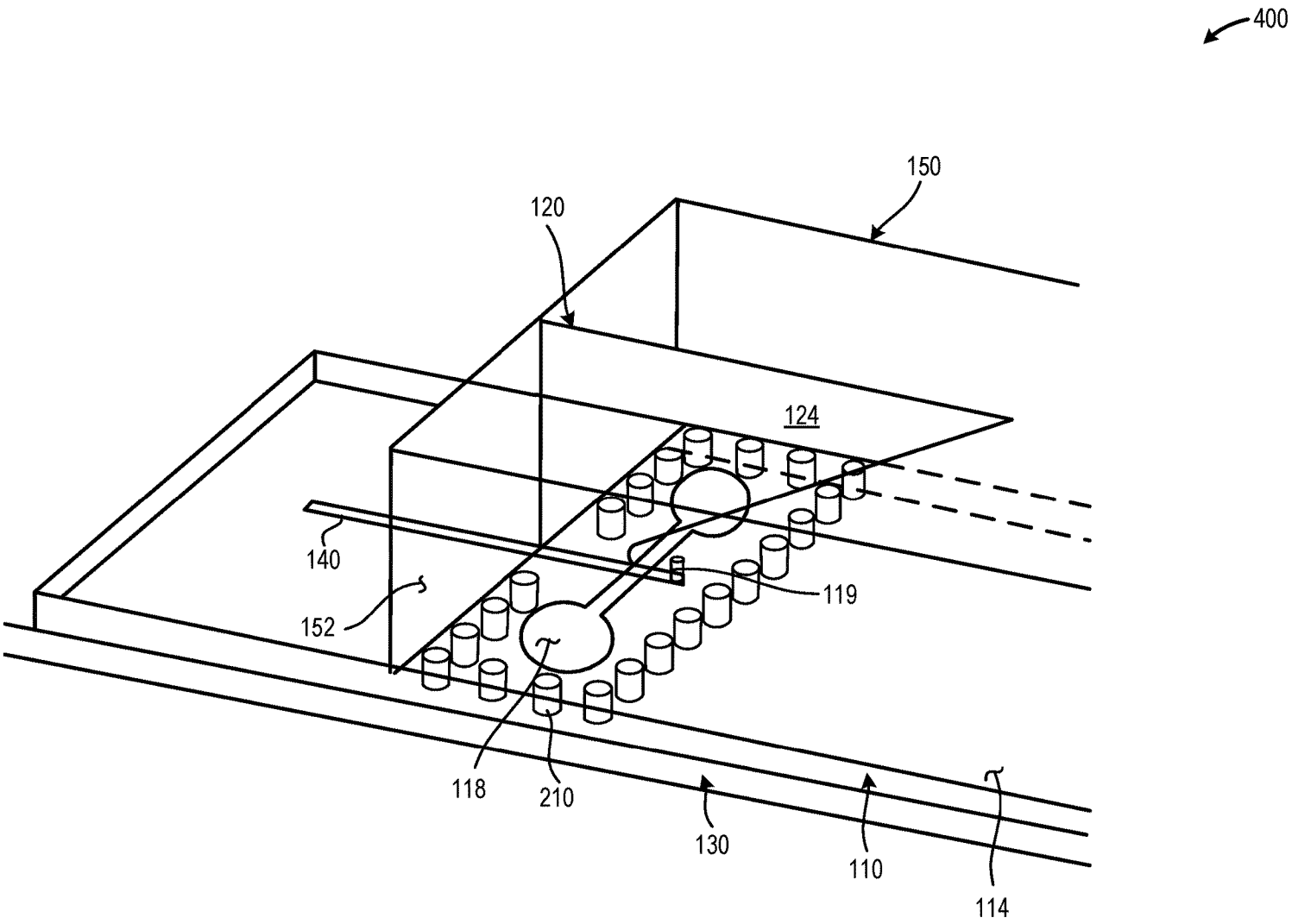
FIG. 4 provides a perspective view of another illustrative traveling wave launcher system that includes a slot-line signal converter and a tapered slot launcher and in which the second electrically conductive member of the tapered slot launcher provides the functionality of the second member of the tapered slot launcher, in accordance with at least one embodiment described herein.

FIG. 4 provides a perspective view of another illustrative traveling wave launcher system 400 that includes a slot-line signal converter 110 and a tapered slot launcher 120 and in which the second electrically conductive member 114 of the tapered slot launcher 120 provides the functionality of the second member 126 of the tapered slot launcher 120, in accordance with at least one embodiment described herein. As depicted in FIG. 4, in some embodiments, the tapered slot launcher 120 may be formed between the first member 126 and at least a portion of the second electrically conductive member 114 forming the slot-line signal converter 110. In such an embodiment, the grounding vias 210 may be conductively coupled to the first electrically conductive member 112 forming the slot-line signal converter 110. As depicted in FIG. 4, the microstrip feed line 140 couples to the first electrically conductive member 112 at connection point 119 proximate the balun structure 118 and on the opposite side of the balun structure 118 from the first member 124 connection. The first member 124 and the portion of the second electrically conductive member 114 forming the second member provide the tapered slot 122 that extends from the first end 125 proximate the balun structure 118 to a second end 127 distal from the balun structure 118.

The traveling wave launcher system 400 depicted in FIG. 4 advantageously facilitates automated manufacturing processes and permits the correct positioning of the first member 124 with respect to the balun structure 118 and the connection point 119 for the microstrip feed line to the slot-line signal converter 110. The traveling wave launcher system 400 beneficially provides wider bandwidth than patch or stacked patch launchers while beneficially improving the energy efficiency of the overall traveling wave launcher system 400 over patch or stacked patch launchers.

Figure 5A:
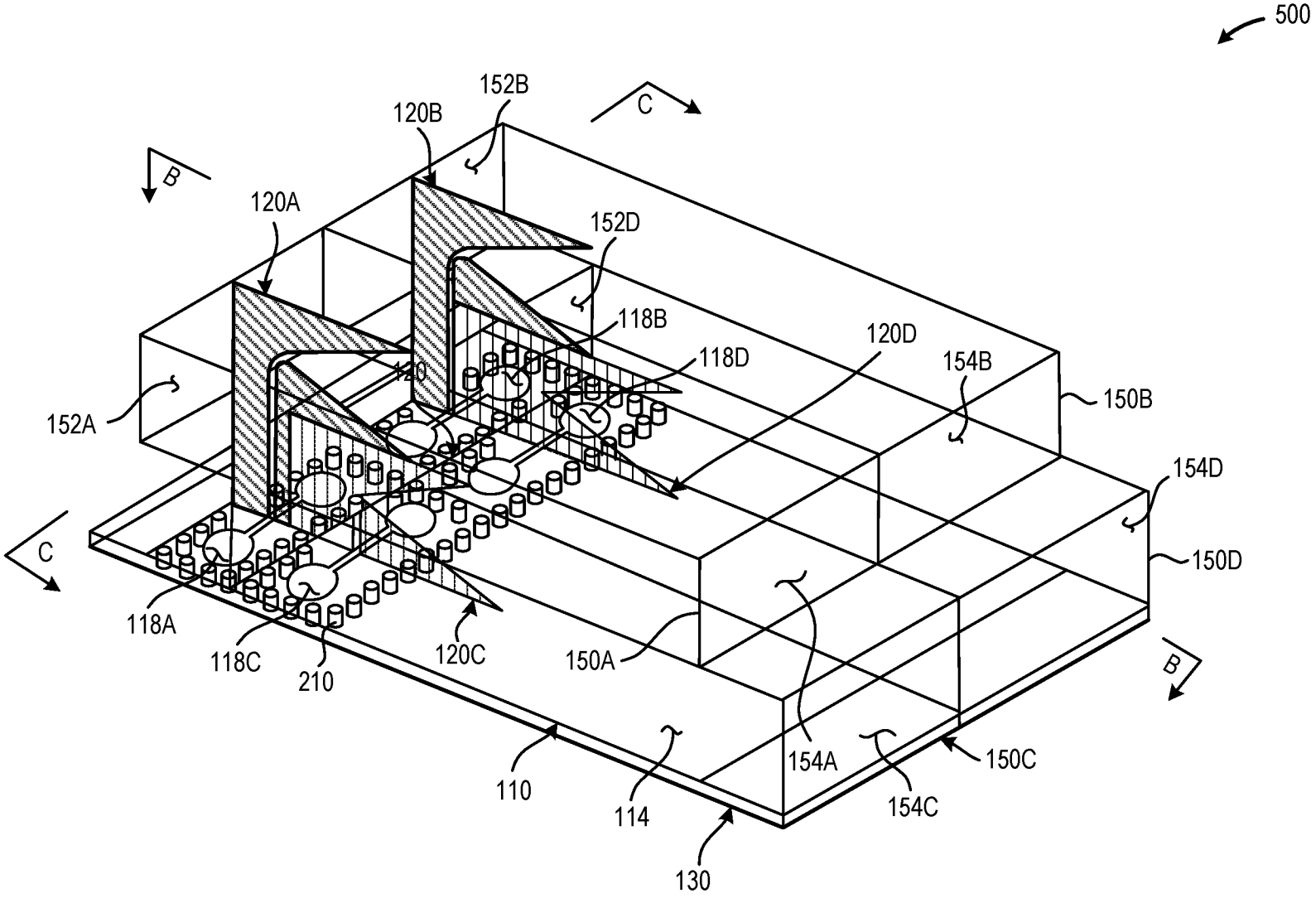
FIG. 5A provides a perspective view of an illustrative three-dimensional traveling wave launcher system that includes a semiconductor package having a single slot-line signal converter communicably coupled to four (4) separate balun structures operably coupled to a respective tapered slot launcher that is, in turn, operably coupled to a respective waveguide connector, in accordance with at least one embodiment described herein.
Figure 5B:
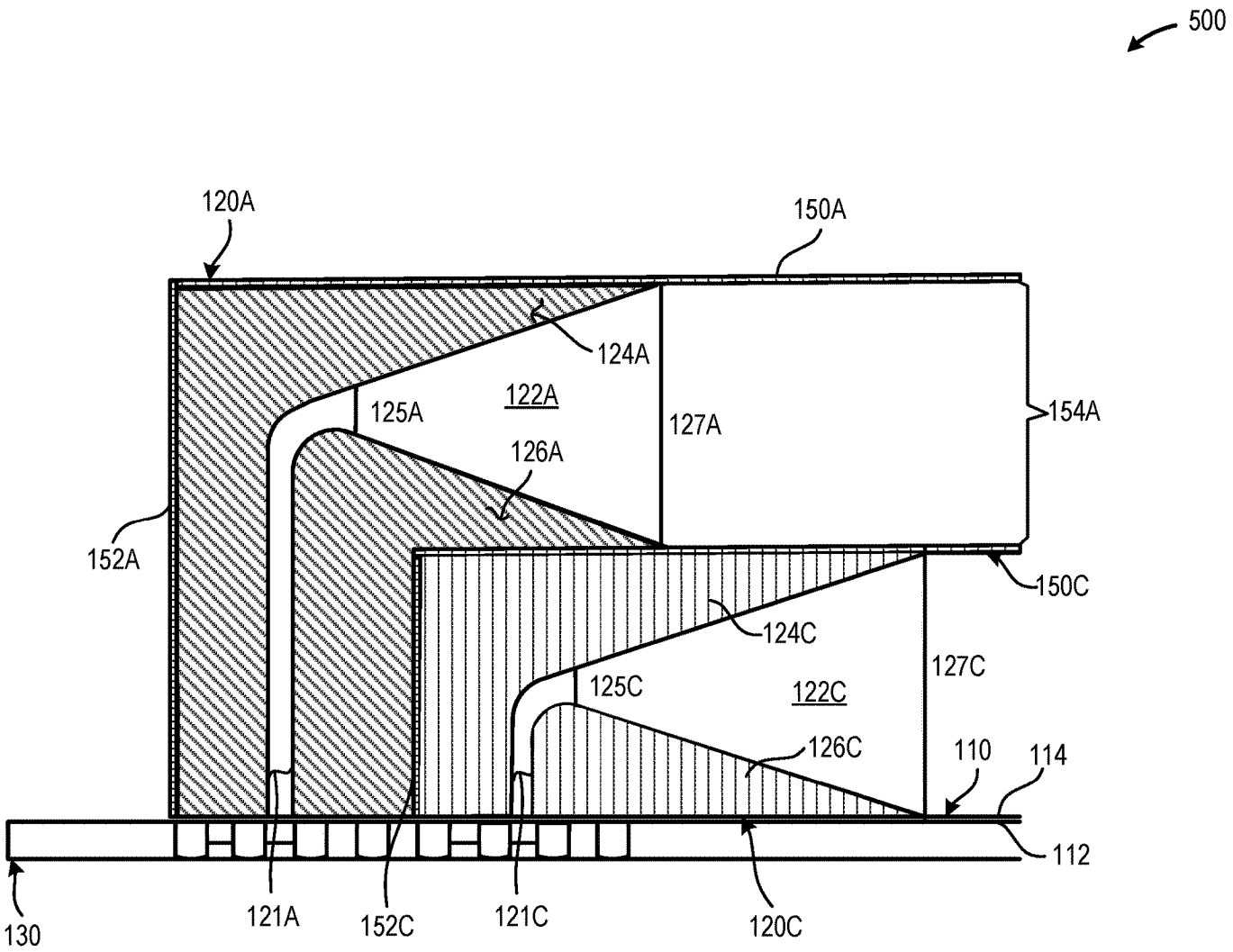
FIG. 5B provides a cross-sectional elevation of the three-dimensional traveling wave launcher system depicted in FIG. 5A, in accordance with at least one embodiment described herein.
Figure 5C:
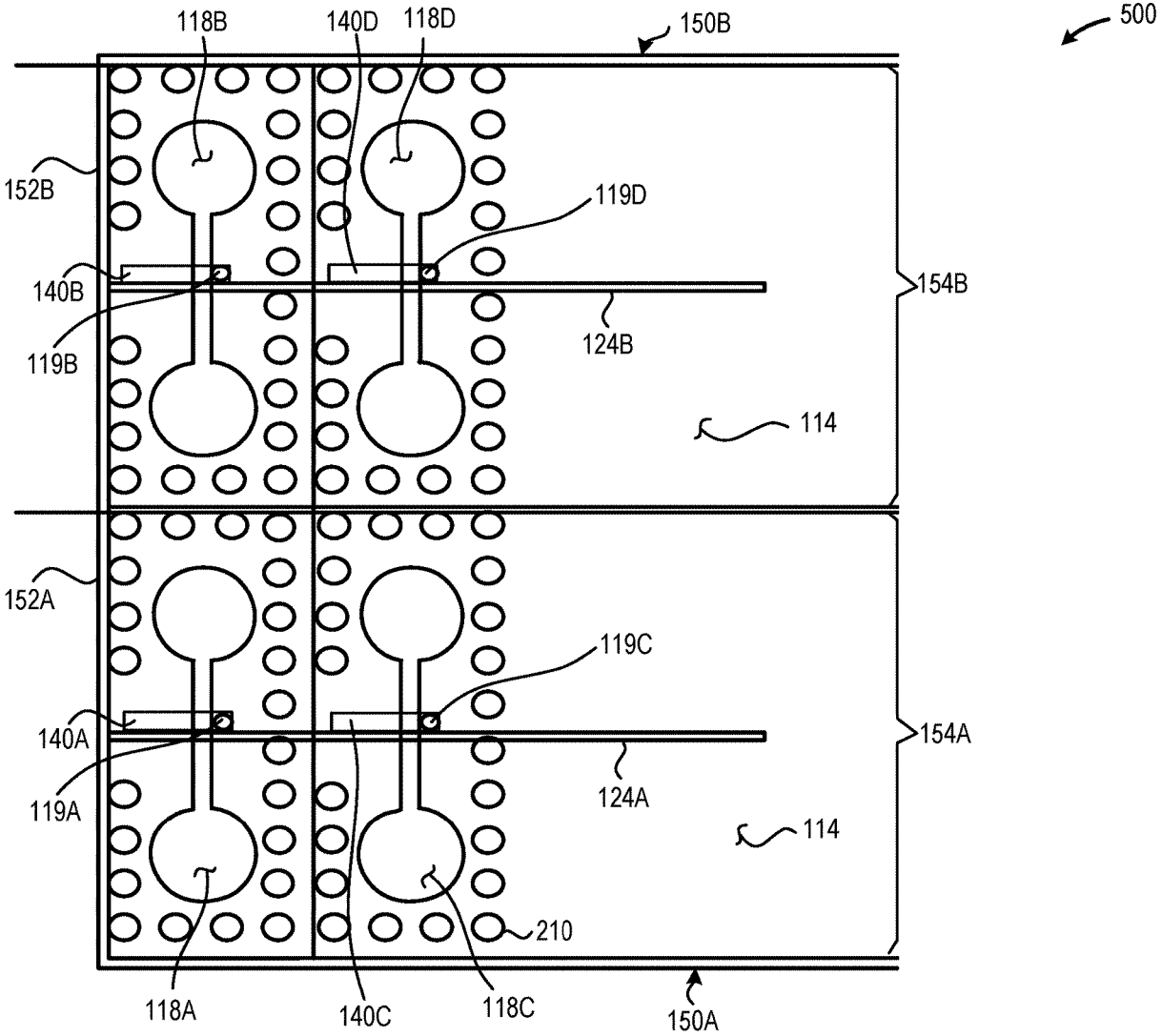
FIG. 5C provides a cross-sectional plan of the three-dimensional traveling wave launcher system depicted in FIG. 5B, in accordance with at least one embodiment described herein.

FIG. 5A provides a perspective view of an illustrative three-dimensional traveling wave launcher system 500 that includes a semiconductor package 130 having a single slot-line signal converter 110 communicably coupled to four (4) separate balun structures 118A-118D (collectively, "balun structures 118") operably coupled to a respective tapered slot launcher 120A-120D (collectively, "tapered slot launchers 120") that is, in turn, operably coupled to a respective waveguide connector 150A-150D (collectively, "waveguide connectors 150), in accordance with at least one embodiment described herein. FIG. 5B provides a cross-sectional elevation of the three-dimensional traveling wave launcher system 500 depicted in FIG. 5A, in accordance with at least one embodiment described herein. FIG. 5C provides a cross-sectional plan of the three-dimensional traveling wave launcher system 500 depicted in FIG. 5B, in accordance with at least one embodiment described herein.

In embodiments, each semiconductor package 130 may include one or more operably coupled slot-line signal converters 110. For example, a single semiconductor package 130 may include two, three, four, five, or more slot-line signal converters 110. Each of the operably coupled slot-line signal converters 110 may, in turn, include one or more tapered slot launchers 120 operably coupled to a respective waveguide connector 150. Thus, although an example 2×2 three dimensional traveling wave launcher system 500 is illustrated in FIGS. 5A-5C, those of skill in the art will readily appreciate such three-dimensional traveling wave launcher systems 500 may include any number of rows and/or any number of columns, each including at least one tapered slot launcher 120 and at least one operably coupled waveguide connector 150.

As evidenced in FIGS. 5A-5C, extending the first member 124 and the second member 126 forms an extended feed channel 121. The extended feed channel 121 permits the slot-line mode signal produced by a balun structure 118 to travel to a tapered slot launcher 120 on an upper "level" of the three-dimensional traveling wave launcher system 500. In some instances, some or all of the tapered slot launchers 120 may be electrically isolated (e.g., by a thin insulator, dielectric layer, or similar) from some or all of the other tapered slot launchers 120 included in the three-dimensional traveling wave launcher system 500. In some instances, some or all of the waveguide connectors 150 (e.g., by a thin insulator, dielectric layer, insulative coating, dielectric coating, or similar) may be electrically isolated from some or all of the other waveguide connectors 150 included in the three-dimensional traveling wave launcher system 500.

As depicted in FIG. 5A, the slot-line signal converter 110 includes four balun structures 118A-118D, each of which includes a respective microstrip feed line 140A-140D (collectively, "microstrip feed lines 140"), and a respective connection point 119A-119D (collectively, "connection points 119"). A number of grounding vias 210 conductively couple the slot-line signal converter 110 to a ground plane in the semiconductor package 130.

As depicted in FIGS. 5A-5C, each of the tapered slot launchers 120 is disposed at least partially within a respective waveguide connector 150. In embodiments, some or all of the tapered slot launchers 120 operate at the same frequency or within the same frequency band. In embodiments, some or all of the tapered slot launchers 120 operate at different frequencies, at different frequencies within the same frequency band, or at different frequencies within different frequency bands. Thus, each of the tapered slot launchers 120 included in a two-dimensional or three-dimensional array may have a physical parameters and/or geometry selected based at least in part on the proposed operating frequency and/or frequency band of the respective tapered slot launcher 120. Further, each of the balun structures 118 formed in the slot-line signal converter 110 may have physical parameters and/or geometry selected based at least in part on the proposed operating frequency and/or frequency band of the respective signal received via the microstrip feed line 140 and connection point 119.

Advantageously, the three-dimensional traveling wave launcher system 500 depicted in FIGS. 5A-5C is amenable to standard printed circuit board manufacturing processes. Further, the three-dimensional traveling wave launcher system 500 depicted in FIGS. 5A-5C also beneficially promotes the correct alignment of the tapered slot launchers 120 with the balun structures 118 formed in the slot-line signal converter 110, thereby providing an operable coupling featuring high efficiency and wide bandwidth between the tapered slot launcher 120 and the waveguide connector 150.

Figure 6B:
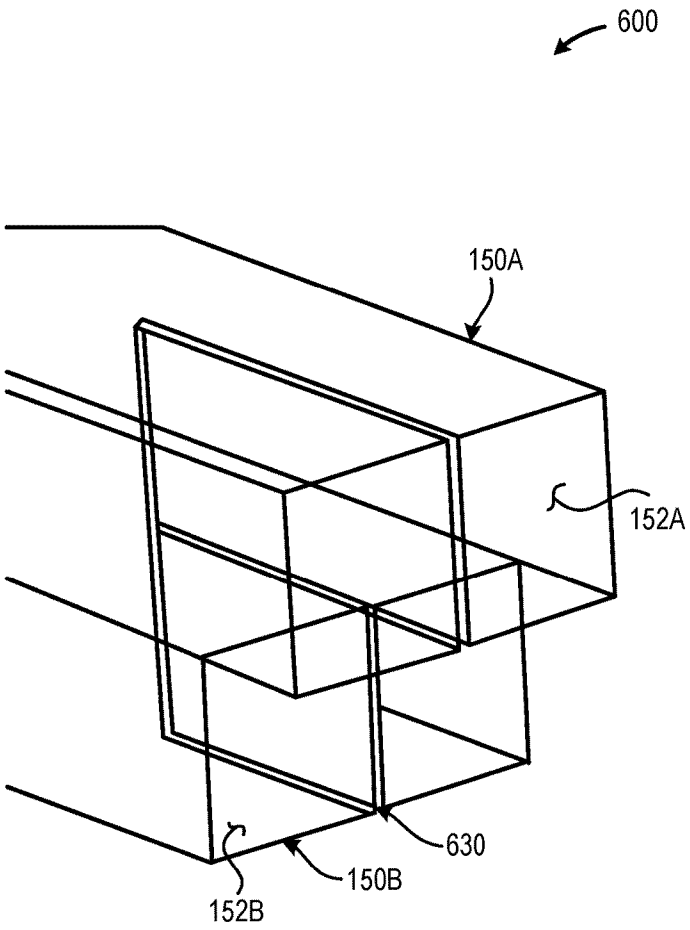
FIG. 6B depicts two (2) illustrative stacked waveguide connectors, each containing a slot to accommodate the operable coupling of the illustrative stacked traveling wave launcher system depicted in FIG. 6A, in accordance with at least one embodiment described herein.
Figure 6A:
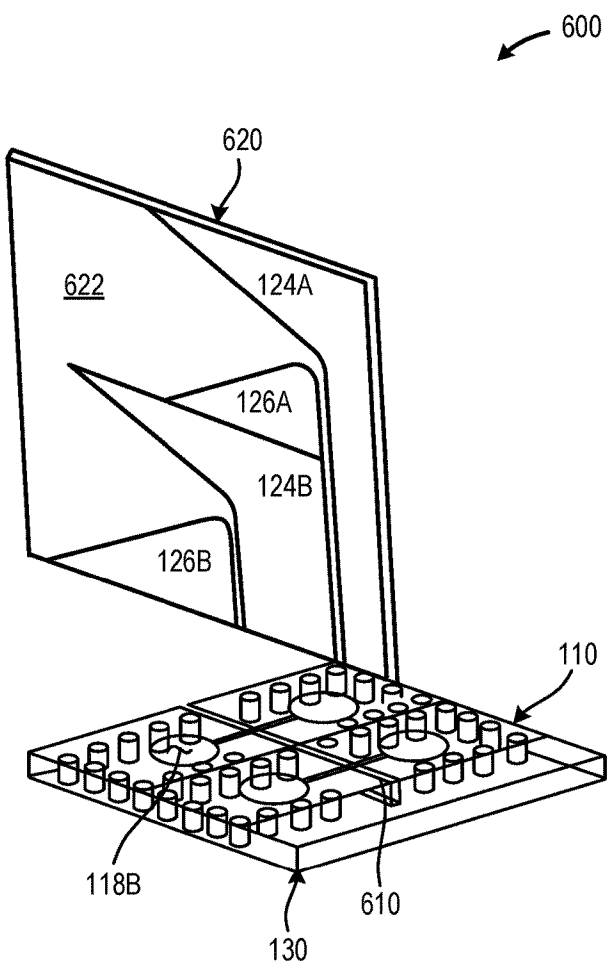
FIG. 6A provides a perspective view of an illustrative traveling wave launcher system formed by inserting a substrate containing two (2) patterned, stacked, tapered slot launchers into a slot 610 formed in a slot-line signal converter 110, in accordance with at least one embodiment described herein.

FIG. 6A provides a perspective view of an illustrative traveling wave launcher system 600 formed by inserting a substrate 620 containing two (2) patterned, stacked, tapered slot launchers 120A and 120B (collectively, "tapered slot launchers 120") into a slot 610 formed in a slot-line signal converter 110, in accordance with at least one embodiment described herein. FIG. 6B depicts two (2) illustrative stacked waveguide connectors 150A and 150B, each containing a slot for the operable coupling of the illustrative stacked traveling wave launcher system 600 depicted in FIG. 6A, in accordance with at least one embodiment described herein.

As depicted in FIG. 6A, in some implementations, one or more slots 610 may be formed in and extend at least partially through the slot-line signal converter 110 and/or the underlying semiconductor package 130. The one or more slots 610 accommodate the slideable insertion of a substrate 620 that includes one or more tapered slot launchers 120 that are printed, patterned, or otherwise deposited in, on, or about at least a portion of the substrate 610. In some implementations, the substrate 620 containing the tapered slot launchers 120 may be conductively coupled to the slot-line signal converter 110 via solder, conductive adhesives or similar. In other implementations, all or a portion of the one or more slots 610 formed in the slot-line signal converter 110 may be edge plated and may conductively couple to lands, pads, tabs or similar conductive structures disposed in, on, or about the substrate 620.

The slot-line signal converter 110 and the operably coupled substrate 620 containing the one or more tapered slot launchers 120 may be slideably inserted into a slot 630 formed in a bundle 640 that includes a number of waveguide connectors 150 corresponding to the number of tapered slot launchers 120 included on the substrate 620. In some implementations, the bundle 640 may operably couple to the substrate 610, the slot-line signal converter 110, or both the substrate 610 and the slot-line signal converter 110.

Figure 7B:
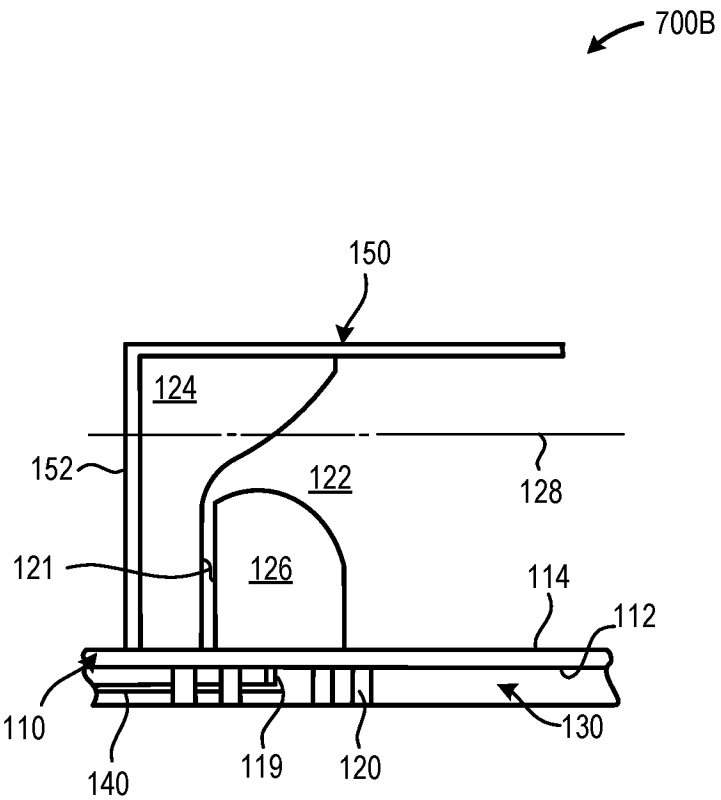
FIG. 7B provides a cross-sectional view of an illustrative traveling wave launcher system in which a tapered slot launcher includes a first member and a second member having a parabolic second edge extending from a first end to a second end of each member, in accordance with at least one embodiment described herein.
Figure 7A:
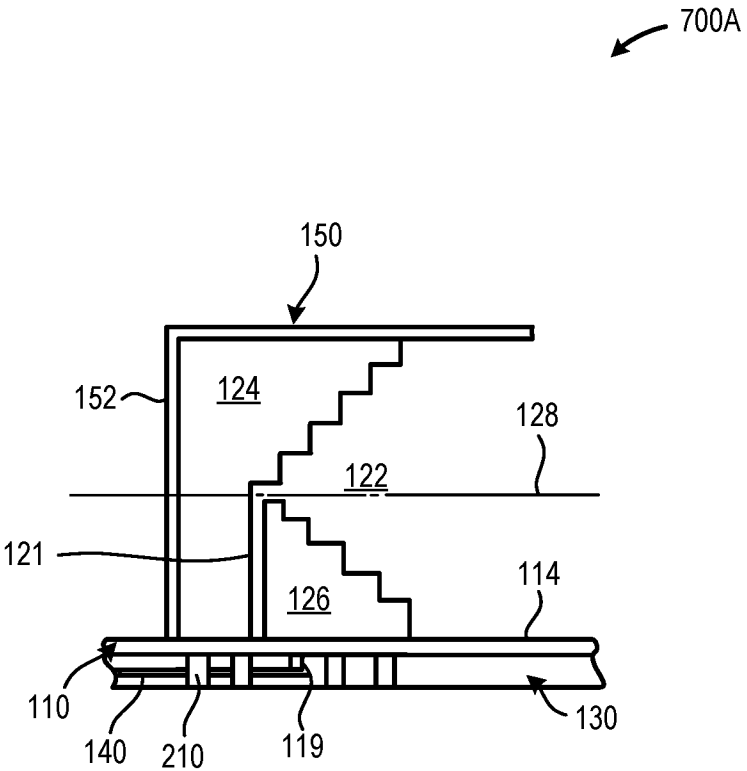
FIG. 7A provides a cross-sectional elevation view of an illustrative system in which a tapered slot launcher includes first and second members each having a stepped second edge extending from a first end to a second end of each member, in accordance with at least one embodiment described herein.

FIG. 7A provides a cross-sectional elevation view of an illustrative system 700A in which a tapered slot launcher 120 includes first and second members 124, 126, each having a stepped second edge 124$E_2$, 126$E_2$ extending from a first end to a second end of each member, in accordance with at least one embodiment described herein. In some implementations, a stepped edge tapered slot launcher 120 may be used based, at least in part, on the operating frequency and/or frequency ranges of the traveling wave signals propagated by the traveling wave launcher system 700A. The pitch of the steps (e.g., the width and height of each step) may be the same or different and may be determined or otherwise selected based at least in part on the operating frequency and/or frequency band of the traveling wave launcher system 700A.

FIG. 7B provides a cross-sectional view of an illustrative traveling wave launcher system 700B in which a tapered slot launcher 120 includes a first member 124 and a second member 126 having a parabolic second edge 124$E_2$, 126$E_2$ extending from a first end 125 to a second end 127 of each member, in accordance with at least one embodiment described herein. In some implementations, a parabolic edge tapered slot launcher 120 may be used based, at least in part, on the operating frequency and/or frequency ranges of the traveling wave signals propagated by the traveling wave launcher system 700B. The curvature of the parabolic edge tapered slot launcher 120 may be determined or otherwise selected based at least in part on the operating frequency and/or frequency band of the traveling wave launcher system 700B.

Figure 7C:
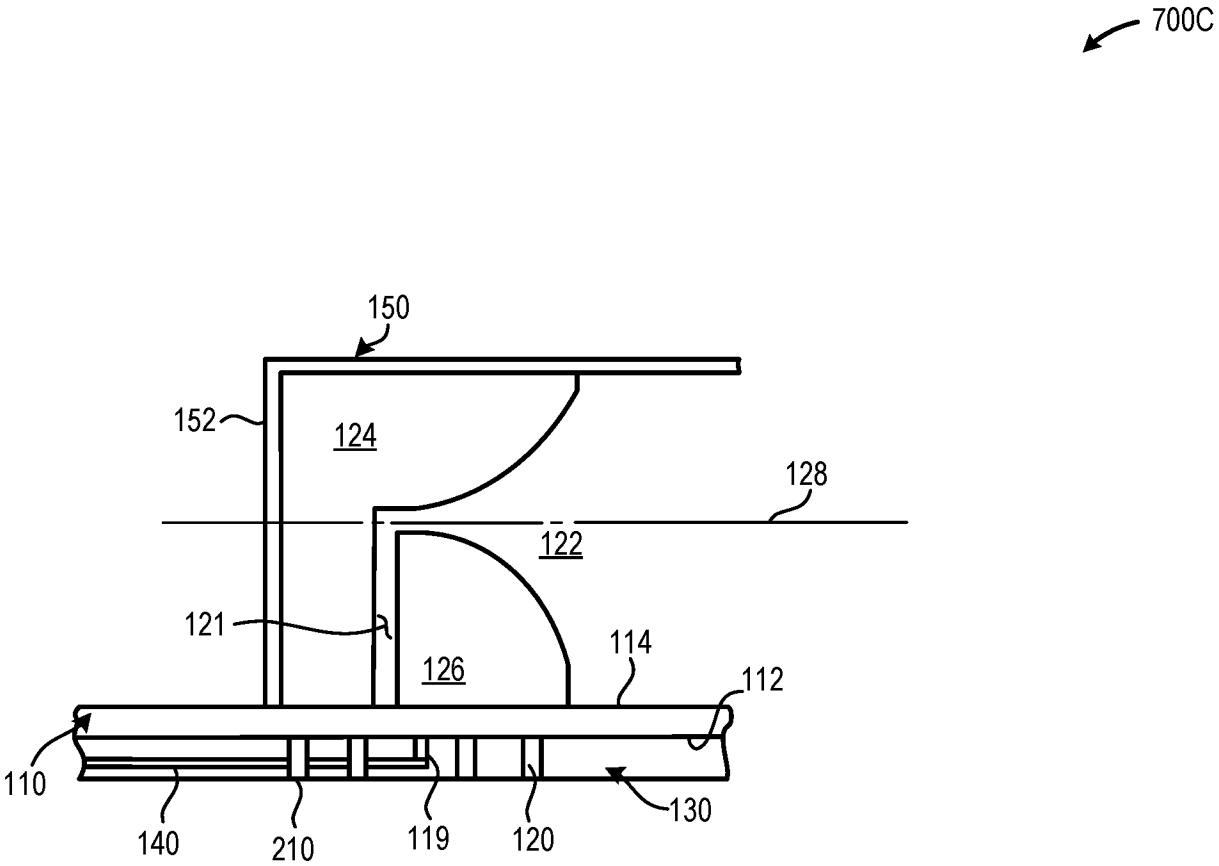
FIG. 7C provides a cross-sectional view of an illustrative traveling wave launcher system in which a tapered slot launcher includes a first member and a second member having a curved second edge extending from a first end to a second end of each member, in accordance with at least one embodiment described herein.

FIG. 7C provides a cross-sectional view of an illustrative traveling wave launcher system 700C in which a tapered slot launcher 120 includes a first member 124 and a second member 126 having a curved second edge 124$E_2$, 126$E_2$ extending from a first end 125 to a second end 127 of each member, in accordance with at least one embodiment described herein. In some implementations, a curved edge tapered slot launcher 120 may be used based, at least in part, on the operating frequency and/or frequency ranges of the traveling wave signals propagated by the traveling wave launcher system 700C. The radius of curvature of the curved edge tapered slot launcher 120 may be increasing, decreasing, or constant and may be determined or otherwise selected based at least in part on the operating frequency and/or frequency band of the traveling wave launcher system 700C.

Figure 8:
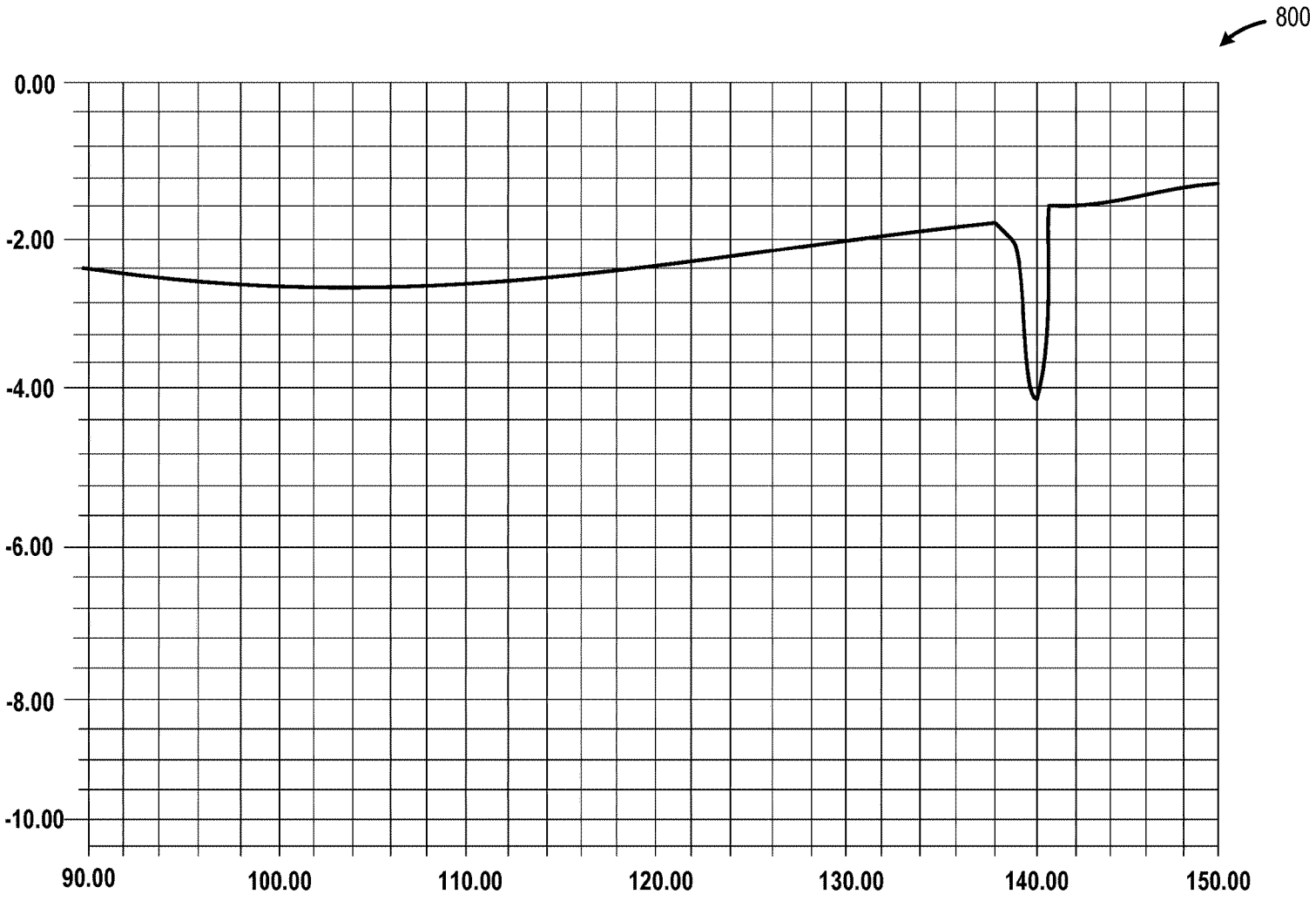
FIG. 8 provides a plot depicting the insertion loss (in dB) of a tapered slot launcher as a function of frequency (in GHz), in accordance with at least one embodiment described herein.

FIG. 8 provides a plot 800 depicting the transmission coefficient (in dB) of a tapered slot launcher 100 as a function of frequency (in GHz). As depicted in FIG. 8, the insertion loss attributable to the traveling wave launcher systems and methods described herein is less than approximately 2.5 dB across at least a portion of the microwave (mm-wave) spectrum.

Figure 9:
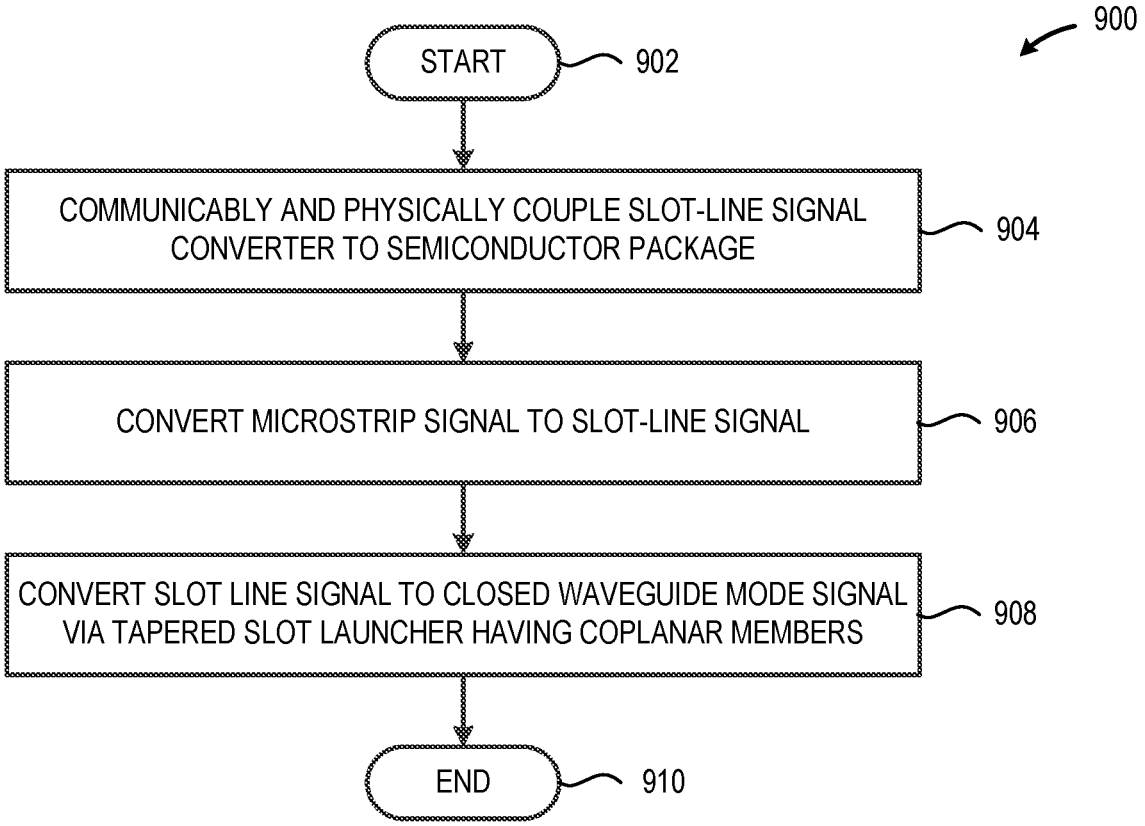
FIG. 9 provides a high-level logic flow diagram of an illustrative method for launching a traveling wave signal in a waveguide connector using a traveling wave launcher system, in accordance with at least one embodiment described herein.

FIG. 9 provides a high-level logic flow diagram of an illustrative method 900 for launching a traveling wave signal in a waveguide connector 150 using a traveling wave launcher system, in accordance with at least one embodiment described herein. One or more devices or systems included in a semiconductor package 130 may generate a high frequency signal (e.g., a microwave frequency signal having a frequency between 30 GHz and 300 GHz) for transmission to one or more other semiconductor packages. The transmission of such signals may be performed wirelessly using either conductive or dielectric waveguide connectors 150. The method 900 commences at 902.

At 904, a slot-line signal converter 110 is physically and communicably coupled to a semiconductor package 130. In some implementations, the slot-line signal converter 110 may include a first electrically conductive member 112 conductively coupled to a second electrically conductive member 114. A tapered slot launcher 120 communicably couples to the second electrically conductive member 114. At least a portion of the first electrically conductive member 112 and at least a portion of the second electrically conductive member 114 include a balun structure 118. In embodiments, the balun structure 118 includes a double-lobed or "barbell" shaped balun structure 118.

In some implementations, the first electrically conductive member 112 may be patterned on at least a portion of an exterior surface of the semiconductor package 130. In such implementations, the second electrically conductive member 114 may be physically and/or communicably coupled to a waveguide connector 150 and the second electrically conductive member 114 may be physically and/or conductively coupled to the first electrically conductive member 112.

In some implementations, the slot-line signal converter 110 may include a single conductive member in which all or a portion of the lower surface includes the first electrically conductive member 112 and all or a portion of the upper surface includes the second electrically conductive member 114. In such implementations, the first electrically conductive member 112 may physically and/or communicably couple to one or more contacts, lands, pads, or similar structures disposed in, on, or about all or a portion of the external surface of the semiconductor package 130.

At 906, the signal transmitted to the traveling wave launcher system 100 is converted from a microstrip signal to a slot-line signal. In some implementations, the balun structure 118 in the slot-line signal converter 110 converts the microstrip signal to the slot-line signal. In some implementations, the microstrip signal is introduced to at a connection point 119 near the geometric and/or physical center of the balun structure 118. In other implementations, the slot-line signal maybe converted to other types of package waveguides such as coplanar waveguide or strip-line.

At 908, a tapered slot launcher 120 converts the slot line signal received from the balun structure 118 to a closed waveguide mode signal. The tapered slot launcher 120 is physically and/or conductively coupled to the second electrically conductive member 114 and includes a co-planar first member 124 and second member 126 spaced apart by a gap 122 that forms the "slot" portion of the tapered slot launcher 120. The physical geometry of the tapered slot launcher 120 may include first and second plates having: a straight second edge 124$E_2$, 126$E_2$ forming the slot 122; a stepped second edge 124$E_2$, 126$E_2$ forming the slot 122; a curved second edge 124$E_2$, 126$E_2$ forming the slot 122; or a parabolic second edge 124$E_2$, 126$E_2$ forming the slot 122. The method 900 concludes at 910.

Figure 10:
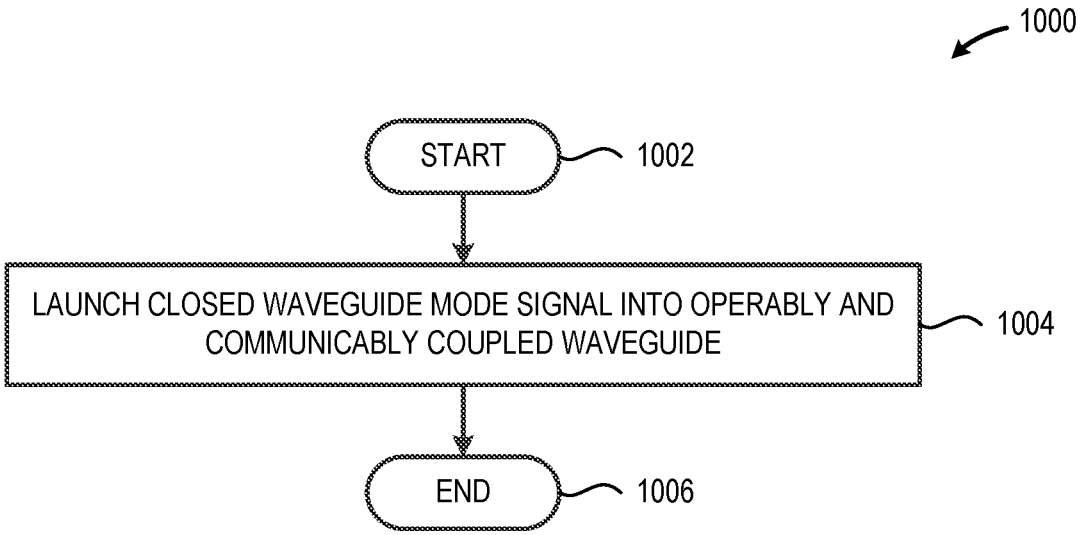
FIG. 10 provides a high-level flow diagram of an illustrative mm-wave signal transmission method useful with the method described in detail with regard to FIG. 9, in accordance with at least one embodiment described herein.

FIG. 10 provides a high-level flow diagram of a mm-wave signal transmission method 1000 useful with the method 900 described in detail with regard to FIG. 9, in accordance with at least one embodiment described herein. The traveling wave signal produced by the tapered slot launcher 120 may be communicated to one or more external devices via the waveguide 150 communicably coupled to the second electrically conductive member 114 and/or to the tapered slot launcher 120. The method 1000 commences at 1002.

At 1004, the tapered slot launcher 120 launches the closed waveguide mode signal into a waveguide connector 150 physically and/or communicably coupled to the traveling wave launcher system. In some implementations, a single traveling wave signal having a single polarization may be launched into the waveguide connector 150. The method 1000 concludes at 1006.

Figure 11:
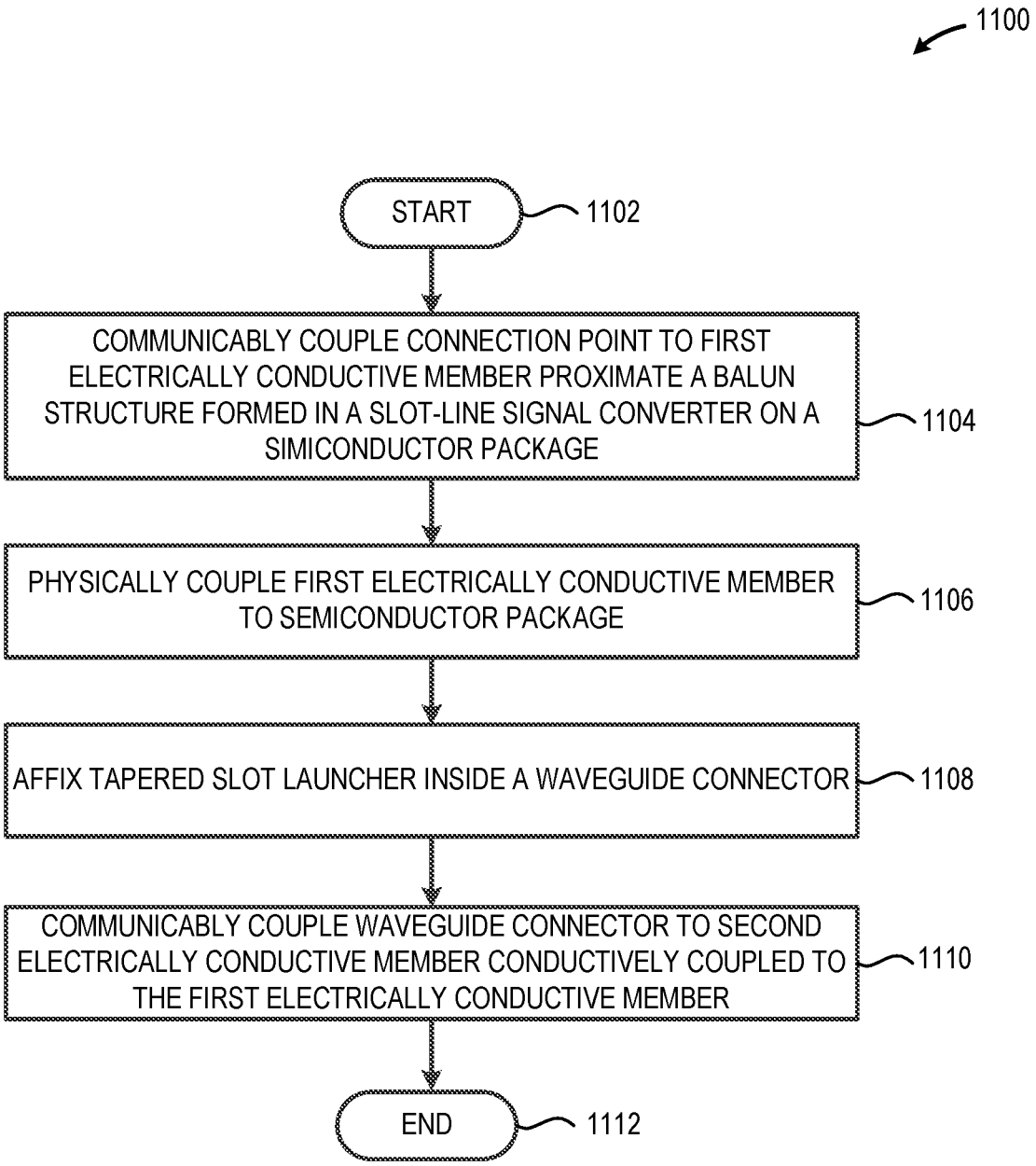
FIG. 11 provides a high-level flow diagram of an illustrative tapered slot waveguide launcher manufacturing method, in accordance with at least one embodiment described herein.

FIG. 11 provides a high level logic-flow diagram of an illustrative tapered slot launcher manufacturing method 1100, in accordance with at least one embodiment described herein. The method 1100 commences at 1102.

At 1104, a connection point 119 disposed in, on, or about a semiconductor package 130 is communicably coupled to a first electrically conductive member 112 of a slot-line signal converter 110. The connection point 119 links a microstrip feed line to the slot-line signal converter 110 at a location proximate a balun structure 118 formed in, on, or about the slot-line signal converter 110. In embodiments, the connection point may receive a radio frequency or microwave signal from a die disposed in or communicably coupled to the semiconductor package 130.

At 1106, the first electrically conductive member 112 is physically and/or communicably coupled to at least a portion of an exterior surface of the semiconductor package 130. In some implementations, the first electrically conductive member 112 may be patterned, formed, or otherwise disposed on at least a portion of the exterior surface of the semiconductor package 130. In some implementations, the first electrically conductive member 112 conductively, physically, and/or operably couples to one or more ground vias 210 disposed in, on, or about the semiconductor package 130. In some implementations, the first electrically conductive member 112 may include a separate member that is physically bonded or affixed to at least a portion of the exterior surface of the semiconductor package 130.

At 1108, at least a portion of a tapered slot launcher 120 is physically affixed and/or conductively coupled to an interior of a waveguide connector 150. In some embodiments, a planar first member 124 that includes at least one edge 124$E_2$ forming at least a portion of the tapered slot launcher 120 may be physically affixed and/or conductively coupled to the interior of the waveguide connector 150. In some implementations, all or a portion of the first member 124 may be formed integrally with the waveguide connector 150. In other implementations, all or a portion of the first member 124 may be physically and/or conductively coupled, bonded, or otherwise affixed to the interior of the waveguide connector 150. The tapered slot launcher 120 includes a planar second member 126.

At 1110, the waveguide connector 150 and at least the first member 124 are physically and/or conductively coupled to a second electrically conductive member 114 included in the slot-line signal converter 110. The second electrically conductive member 114 is conductively coupled to the first electrically conductive member 112. In some implementations, the first electrically conductive member 112 may include a first side or surface of an electrically conductive member and the second electrically conductive member 114 may include an opposed side of the same electrically conductive member. When the waveguide connector 150 is coupled to the second electrically conductive member 114, the first member conductively couples to the second electrically conductive member 114 at a first location proximate the balun structure 118 formed in the slot-line signal converter 110. The second member 126 conductively couples to the second electrically conductive member 114 at a second location proximate the balun structure 118, the second location on an opposite side of the balun structure 118 as the first location where the first member 124 conductively couples.

In some implementations, the second member 126 may be a planar member having at least one edge 126$E_2$ physically affixed and/or conductively coupled to the interior of the waveguide connector 150. The second member 126 is a planar member that is co-planarly aligned with the first member 124 such that the at least one edge 124$E_2$ of the first member 124 and the at least on edge 126$E_2$ of the second member 126 form the tapered slot 122. In such implementations, affixing the waveguide connector 150 to the second electrically conductive member 114 positions the second member 126 at the second location proximate the balun structure 118. In other implementations, the second member 126 may include all or a portion of the second electrically conductive member 114. In such an instance, the first member 124 and the second member 126 may be perpendicularly aligned. The method 1100 concludes at 1112.

While FIGS. 9, 10, and 11 illustrate operations according to different embodiments, it is to be understood that not all of the operations depicted in FIGS. 9, 10, and 11 are necessary for other embodiments. Indeed, it is fully contemplated herein that in other embodiments of the present disclosure, the operations depicted in FIGS. 9, 10, and 11 and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

Additionally, operations for the embodiments have been further described with reference to the above figures and accompanying examples. Some of the figures may include a logic flow. Although such figures presented herein may include a particular logic flow, it can be appreciated that the logic flow merely provides an example of how the general functionality described herein can be implemented. Further, the given logic flow does not necessarily have to be executed in the order presented unless otherwise indicated. In addition, the given logic flow may be implemented by a hardware element, a software element executed by a processor, or any combination thereof. The embodiments are not limited to this context.

According to example 1, there is provided a microwave waveguide connector and slot launcher apparatus. The apparatus includes a slot line signal converter and a tapered slot launcher. The slot-line signal converter may include a first electrically conductive member communicably coupleable to a semiconductor package; a planar second electrically conductive member conductively coupled to the first electrically conductive member, at least a portion of the second electrically conductive member communicably coupleable to a waveguide member; and a balun structure to convert a signal to a slot-line signal. The tapered slot launcher may include a tapered slot launcher to emit a traveling wave signal having an axis of propagation parallel to the plane of the second electrically conductive member, the tapered slot launcher including a first member and a second member; wherein the first member and the second member include spaced apart coplanar members that form an open-ended, tapered slot co-aligned with the axis of propagation of the traveling wave signal; wherein the first member communicably couples to the second electrically conductive member at a first location proximate the balun structure; and wherein the second member communicably couples to the second electrically conductive member at a second location proximate the balun structure.

Example 2 may include elements of example 1 and the apparatus may additionally include a second tapered slot launcher to emit a second traveling wave signal having an axis of propagation parallel to the plane of the second electrically conductive member, the second tapered slot launcher including a first member and a second member; wherein the slot-line signal converter further includes a second balun structure; wherein the first member and the second member forming the second tapered slot launcher include spaced apart coplanar members that form an open-ended, tapered slot co-aligned with the axis of propagation of the traveling wave signal; wherein the first member of the second tapered slot launcher communicably couples to the second electrically conductive member at a first location proximate the second balun structure; and wherein the second member of the second tapered slot launcher communicably couples to the second electrically conductive member at a second location proximate second balun structure.

Example 3 may include elements of example 2 where the co-planar first member and second member forming the tapered slot launcher and the co-planar first member and second member forming the second tapered slot launcher are co-planar.

Example 4 may include elements of example 3 where the tapered slot launcher generates a first traveling wave signal; and the second tapered slot launcher generates a second traveling wave signal.

Example 5 may include elements of example 1 where the first electrically conductive member may include a member patterned on the semiconductor package; the second electrically conductive member may include a member coupled to the tapered slot launcher; and the first electrically conductive member is conductively coupleable to the second electrically conductive member.

Example 6 may include elements of example 5 where the balun structure included in the slot-line signal converter may include a first balun structure having a first physical geometry formed in the first electrically conductive member; and a second balun structure having a second physical geometry formed in the second electrically conductive member.

Example 7 may include elements of example 6 where the first physical geometry comprises a double-lobed balun structure that may include at least one of: double circular lobes; double rectangular lobes; double wedge-shaped lobes; or double hexagonal lobes.

Example 8 may include elements of example 6 where the second physical geometry comprises a double-lobed balun structure that may include at least one of: double circular lobes; double rectangular lobes; double wedge-shaped lobes; or double hexagonal lobes.

Example 9 may include elements of example 6 where the second physical geometry corresponds to the first physical geometry.

Example 10 may include elements of example 1 where the second electrically conductive member may include a member formed integral with the tapered slot launcher.

Example 11 may include elements of example 1 where the first member forming the tapered slot launcher and the second member forming the tapered slot launcher extend from the second electrically conductive member at an angle of approximately 90 degrees.

Example 12 may include elements of any of examples 1 through 11 where the tapered slot launcher may further include a waveguide connector to accommodate the operable coupling of an external waveguide; wherein at least one of the first member or the second member operably couples to the waveguide connector.

Example 13 may include elements of claim 12 where the waveguide connector operably couples to at least a portion of the second electrically conductive member.

Example 14 may include elements of any of examples 1 through 11 where the tapered slot launcher includes a planar first member and a planar second member patterned on a substrate; and the slot-line signal converter includes a slot formed in at least a portion of an exterior surface of the slot-line signal converter, the slot to accommodate the slideable insertion of the substrate.

Example 15 may include elements of example 14 where the tapered slot launcher may further include a waveguide connector that includes a slot formed in a terminal end of the waveguide connector, the slot to accommodate the slideable insertion of the substrate, wherein the waveguide connector operably couples to the tapered slot launcher on the substrate and to at least the second electrically conductive member of the slot-line signal converter.

According to example 16, there is provided a co-planar tapered slot launcher traveling wave transmission method. The method may include providing a signal to a slot line signal converter communicably coupled to a semiconductor package and physically coupled to an external surface of the semiconductor package; converting the signal to a slot line signal, via a balun structure formed at least partially in the slot line signal converter; and converting the slot-line signal to a closed waveguide mode signal via a tapered slot launcher that includes a first member and a second member, the first member and the second member including spaced apart co-planar members that form an open-ended, tapered slot co-aligned with an axis of propagation of the traveling wave signal.

Example 17 may include elements of example 16 and the method may additionally include launching the closed waveguide mode signal into a waveguide connector operably and communicably coupled to the tapered slot launcher.

Example 18 may include elements of example 16 and the method may additionally include generating the signal using a semiconductor die disposed in the semiconductor package.

Example 19 may include elements of example 16 where converting the slot-line signal to a closed waveguide mode signal via a tapered slot launcher that includes a first member and a second member may include converting the slot-line signal to a closed waveguide mode signal via a tapered slot launcher that may include: a first member communicably coupled to a second electrically conductive member forming the slot-line signal converter at a first location proximate the balun structure; and a second member communicably coupled to the second electrically conductive member forming the slot-line signal converter at a second location proximate the balun structure.

Example 20 may include elements of example 16 where converting the signal to a slot line signal, via a balun structure formed at least partially in the slot line signal converter may include converting the signal to a slot line signal via a slot-line signal converter that may include: a first electrically conductive member including a balun structure having a first physical geometry; and a second electrically conductive member including a balun structure having a second physical geometry, the second electrically conductive member conductively coupled to the first electrically conductive member.

Example 21 may include elements of example 20 where converting the signal to a slot line signal via a slot-line signal converter that includes a first electrically conductive member including a balun structure having a first physical geometry may include converting the signal to a slot line signal via a slot-line signal converter that includes a first electrically conductive member including a balun structure having a first physical geometry that includes a double-lobed balun structure that includes at least one of: double circular lobes; double rectangular lobes; double wedge-shaped lobes; or double hexagonal lobes.

Example 22 may include elements of example 21 where converting the signal to a slot line signal via a slot-line signal converter that includes a second electrically conductive member including a balun structure having a second physical geometry may include: converting the signal to a slot line signal via a slot-line signal converter that includes a second electrically conductive member including a balun structure having a second physical geometry that includes a double-lobed balun structure that includes at least one of: double circular lobes; double rectangular lobes; double wedge-shaped lobes; or double hexagonal lobes.

Example 23 may include elements of example 22 where converting the signal to a slot line signal via a slot-line signal converter that includes: a first electrically conductive member including a balun structure having a first physical geometry; and a second electrically conductive member including a balun structure having a second physical geometry may include: converting the signal to a slot line signal via a slot-line signal converter that includes: a first electrically conductive member including a balun structure having a first physical geometry; and a second electrically conductive member including a balun structure having a second physical geometry, the first physical geometry corresponding to the second physical geometry.

Example 24 may include elements of example 22 where converting the slot-line signal to a closed waveguide mode signal via a tapered slot launcher that includes a first member and a second member, the first member and the second member including spaced apart co-planar members that form an open-ended, tapered slot co-aligned with the axis of propagation of the traveling wave signal may include converting the slot-line signal to a closed waveguide mode signal via a tapered slot launcher that includes a first member and a second member, the first member operably coupled to the slot-line signal converter at a first location proximate the balun structure and the second member operably coupled to the slot-line signal converter at a second location proximate the balun structure and on an opposite side of the balun structure from the first location, the first location and the second location aligned along an axis of propagation of the tapered slot launcher.

According to example 25, there is provided a tapered slot launcher traveling wave transmission system, that includes a means for providing a signal to a slot line signal converter communicably coupled to a semiconductor package and physically coupled to an external surface of the semiconductor package; a means for converting the signal to a slot line signal, via a balun structure formed at least partially in the slot line signal converter; and a means for converting the slot-line signal to a closed waveguide mode signal via a tapered slot launcher that includes a first member and a second member, the first member and the second member including spaced apart co-planar members that form an open-ended, tapered slot co-aligned with an axis of propagation of the traveling wave signal.

Example 26 may include elements of example 25 and the system may additionally include a means for launching the closed waveguide mode signal into a waveguide connector operably and communicably coupled to the tapered slot launcher.

Example 27 may include elements of example 25 and the system may additionally include a means for generating the signal using a semiconductor die disposed in the semiconductor package.

Example 28 may include elements of example 25 where the means for converting the slot-line signal to a closed waveguide mode signal via a tapered slot launcher that includes a first member and a second member may include a means for converting the slot-line signal to a closed waveguide mode signal via a tapered slot launcher that includes: a first member communicably coupled to a second electrically conductive member forming the slot-line signal converter at a first location proximate the balun structure; and a second member communicably coupled to the second electrically conductive member forming the slot-line signal converter at a second location proximate the balun structure.

Example 29 may include elements of example 25 where the means for converting the signal to a slot line signal, via a balun structure formed at least partially in the slot line signal converter may include a means for converting the signal to a slot line signal via a slot-line signal converter that may include: a first electrically conductive member including a balun structure having a first physical geometry; and a second electrically conductive member including a balun structure having a second physical geometry, the second electrically conductive member conductively coupled to the first electrically conductive member.

Example 30 may include elements of example 29 where the means for converting the signal to a slot line signal via a slot-line signal converter that includes a first electrically conductive member including a balun structure having a first physical geometry may include: a means for converting the signal to a slot line signal via a slot-line signal converter that includes a first electrically conductive member including a balun structure having a first physical geometry that includes a double-lobed balun structure that includes at least one of: double circular lobes; double rectangular lobes; double wedge-shaped lobes; or double hexagonal lobes.

Example 31 may include elements of example 30 where the means for converting the signal to a slot line signal via a slot-line signal converter that includes a second electrically conductive member including a balun structure having a second physical geometry may include a means for converting the signal to a slot line signal via a slot-line signal converter that includes a second electrically conductive member including a balun structure having a second physical geometry that includes a double-lobed balun structure that includes at least one of: double circular lobes; double rectangular lobes; double wedge-shaped lobes; or double hexagonal lobes.

Example 32 may include elements of example 31 where the means for converting the signal to a slot line signal via a slot-line signal converter that includes: a first electrically conductive member including a balun structure having a first physical geometry; and a second electrically conductive member including a balun structure having a second physical geometry may include a means for converting the signal to a slot line signal via a slot-line signal converter that includes: a first electrically conductive member including a balun structure having a first physical geometry; and a second electrically conductive member including a balun structure having a second physical geometry, the first physical geometry corresponding to the second physical geometry.

Example 33 may include elements of example 31 where the means for converting the slot-line signal to a closed waveguide mode signal via a tapered slot launcher that includes a first member and a second member, the first member and the second member including spaced apart co-planar members that form an open-ended, tapered slot co-aligned with the axis of propagation of the traveling wave signal may include a means for converting the slot-line signal to a closed waveguide mode signal via a tapered slot launcher that includes a first member and a second member, the first member operably coupled to the slot-line signal converter at a first location proximate the balun structure and the second member operably coupled to the slot-line signal converter at a second location proximate the balun structure and on an opposite side of the balun structure from the first location, the first location and the second location aligned along an axis of propagation of the tapered slot launcher.

According to example 34, there is provided a microwave transmission system. The system may include a semiconductor package that includes a radio frequency (RF) signal producing die; a waveguide connector; a slot line signal converter and a tapered slot launcher. The slot-line signal converter may include: a first electrically conductive member communicably coupleable to a semiconductor package; a planar second electrically conductive member conductively coupled to the first electrically conductive member, at least a portion of the second electrically conductive member communicably coupleable to a waveguide member; and a balun structure to convert a signal to a slot-line signal. The tapered slot launcher may emit a traveling wave signal having an axis of propagation parallel to the plane of the second electrically conductive member. The tapered slot launcher may include: a first member and a second member; wherein the first member and the second member include spaced apart coplanar members that form an open-ended, tapered slot co-aligned with the axis of propagation of the traveling wave signal; wherein the first member communicably couples to the second electrically conductive member at a first location proximate the balun structure; and wherein the second member communicably couples to the second electrically conductive member at a second location proximate the balun structure.

Example 35 may include elements of example 34, and the system may further include a second tapered slot launcher to emit a second traveling wave signal having an axis of propagation parallel to the plane of the second electrically conductive member, the second tapered slot launcher including a first member and a second member; wherein the slot-line signal converter further includes a second balun structure; wherein the first member and the second member forming the second tapered slot launcher include spaced apart coplanar members that form an open-ended, tapered slot co-aligned with the axis of propagation of the traveling wave signal; wherein the first member of the second tapered slot launcher communicably couples to the second electrically conductive member at a first location proximate the second balun structure; and wherein the second member of the second tapered slot launcher communicably couples to the second electrically conductive member at a second location proximate second balun structure.

Example 36 may include elements of example 35 where the co-planar first member and second member forming the tapered slot launcher and the co-planar first member and second member forming the second tapered slot launcher are co-planar.

Example 37 may include elements of example 36 where the tapered slot launcher generates a first traveling wave signal; and the second tapered slot launcher generates a second traveling wave signal.

Example 38 may include elements of example 34 where the first electrically conductive member may include a member patterned on the semiconductor package; the second electrically conductive member comprises a member coupled to the tapered slot launcher; and the first electrically conductive member is conductively coupleable to the second electrically conductive member.

Example 39 may include elements of example 38 where the balun structure included in the slot-line signal converter may include a first balun structure having a first physical geometry formed in the first electrically conductive member; and a second balun structure having a second physical geometry formed in the second electrically conductive member.

Example 40 may include elements of example 39 where the first physical geometry may include a double-lobed balun structure that includes at least one of: double circular lobes; double rectangular lobes; double wedge-shaped lobes; or double hexagonal lobes.

Example 41 may include elements of example 39 where the second physical geometry comprises a double-lobed balun structure that includes at least one of: double circular lobes; double rectangular lobes; double wedge-shaped lobes; or double hexagonal lobes.

Example 42 may include elements of example 39 where the second physical geometry corresponds to the first physical geometry.

Example 43 may include elements of example 34 where the second electrically conductive member may include a member formed integral with the tapered slot launcher.

Example 44 may include elements of example 34 where the first member forming the tapered slot launcher and the second member forming the tapered slot launcher extend from the second electrically conductive member at an angle of approximately 90 degrees.

Example 45 may include elements of example 34 where the tapered slot launcher may further include a waveguide connector to accommodate the operable coupling of an external waveguide; wherein at least one of the first member or the second member operably couples to the waveguide connector.

Example 46 may include elements of example 45 where the waveguide connector operably couples to at least a portion of the second electrically conductive member.

Example 47 may include elements of example 34 where the tapered slot launcher includes a planar first member and a planar second member patterned on a substrate; and the slot-line signal converter includes a slot formed in at least a portion of an exterior surface of the slot-line signal converter, the slot to accommodate the slideable insertion of the substrate.

Example 48 may include elements of example 47 where the tapered slot launcher further includes a waveguide connector that includes a slot formed in a terminal end of the waveguide connector, the slot to accommodate the slideable insertion of the substrate, wherein the waveguide connector operably couples to the tapered slot launcher on the substrate and to at least the second electrically conductive member of the slot-line signal converter.

According to example 49, there is provided a tapered slot launcher manufacturing method. The method may include communicably coupling a connection point on a semiconductor package to a first electrically conductive member of a slot-line signal converter, the connection point to provide at least one radio frequency (RF) signal to the slot-line signal converter proximate a balun structure formed in the slot-line signal converter; physically coupling the first electrically conductive member to at least a portion of the semiconductor package; affixing at least a portion of a tapered slot launcher inside a waveguide connector, the tapered slot launcher comprising a planar first member and planar second member, the first member including at least one edge forming at least a portion of a tapered slot; and communicably coupling the waveguide connector and the tapered slot launcher to a second electrically conductive member of the slot-line signal converter, the second electrically conductive member conductively coupled to the first electrically conductive member; wherein the first member operably couples to the second electrically conductive member at a first location proximate the balun structure; and wherein the planar second member operably coupled to the second electrically conductive member at a second location proximate the balun structure, the second location disposed on an opposite side of the balun structure from the first location.

Example 50 may include elements of example 49 where affixing at least a portion of a tapered slot launcher inside a waveguide, the tapered slot launcher comprising a planar first member and planar second member, the first member including at least one edge forming a portion of a tapered slot further may include: affixing a tapered slot launcher inside a hollow waveguide, the tapered slot launcher comprising a co-planarly arranged planar first member and planar second member, the first member including at least one edge forming a portion of a tapered slot and the second member including at least one edge forming a remaining portion of the tapered slot.

Example 51 may include elements of example 49 where affixing at least a portion of a tapered slot launcher inside a hollow waveguide, the tapered slot launcher comprising a planar first member and planar second member, the first member including at least one edge forming a portion of a tapered slot further may include: affixing a tapered slot launcher inside a hollow waveguide, the tapered slot launcher comprising a perpendicularly arranged planar first member and planar second member, the second electrically conductive member providing at least a portion of the planar second member.

Example 52 may include elements of any of examples 49 through 51 where communicably coupling a connection point on a semiconductor package to a first electrically conductive member of a slot-line signal converter may include: patterning the first electrically conductive member on the portion of the semiconductor package.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. Thus, the breadth and scope of the present invention should not be limited by any of the above-described exemplary embodiments, but should be defined only in accordance with the following claims and their equivalents.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

What is claimed:

1. A microwave transmission system, comprising:

a semiconductor package that includes a radio frequency (RF) signal producing die;

a waveguide connector;

a slot line signal converter that includes:

a first electrically conductive member communicably coupleable to a semiconductor package;

a planar second electrically conductive member conductively coupled to the first electrically conductive member, at least a portion of the second electrically conductive member communicably coupleable to a waveguide member; and a balun structure to convert a signal to a slot-line signal;

wherein the slot line signal converter comprises a slot line signal converter channel that extends at least partially through the plane of the second electrically conductive member;

a stacked slot launcher insert comprising:

a first tapered slot launcher to emit a first traveling wave signal having an axis of propagation parallel to the plane of the second electrically conductive member, the first tapered slot launcher including a first member and a second member;

wherein the first member and the second member include spaced apart coplanar members that form a first open-ended, tapered slot co-aligned with the axis of propagation of the first traveling wave signal;

wherein the first member communicably couples to the second electrically conductive member at a first location proximate the balun structure;

wherein the second member communicably couples to the second electrically conductive member at a second location proximate the balun structure; and a second tapered slot launcher to emit a second traveling wave signal having an axis of propagation parallel to the first traveling wave signal, the second tapered slot launcher including a third member and a fourth member;

wherein the third member and the fourth member forming the second tapered slot launcher include spaced apart coplanar members that form a second open-ended, tapered slot co-aligned with the axis of propagation of the second traveling wave signal, wherein the first open-ended, tapered slot is coplanar with the second open-ended, tapered slot, wherein the second slot launcher is stacked on the first slot launcher forming a three-dimensional open-ended, tapered slot array;

wherein the stacked slot launcher insert is at least partially deposited in the slot line signal converter channel such that the first open-ended, tapered slot and the second open-ended, tapered slot are perpendicular to the plane of the second electrically conductive member, and the first traveling wave signal and second traveling wave signal are parallel to the plane of the second electrically conductive member;

wherein the first open-ended, tapered slot has a first geometry to emit the first traveling wave signal having a first frequency;

wherein the second open-ended, tapered slot has a second geometry to emit the second traveling wave signal having a second frequency; and wherein the first and second frequencies are different.

2. A co-planar tapered slot launcher traveling wave transmission method, comprising:

providing signals to a slot line signal converter communicably coupled to a semiconductor package and physically coupled to an external surface of the semiconductor package;

wherein the slot line signal converter comprises a slot line signal converter channel that extends at least partially through an exterior plane of the slot line signal converter;

converting the signals to slot line signals, via a balun structure formed at least partially in the slot line signal converter; and converting the slot-line signals to closed waveguide mode signals via a stacked slot launcher insert comprising a first tapered slot launcher and a second tapered slot launcher, wherein the first tapered slot launcher includes a first member and a second member, the first member and the second member including spaced apart co-planar members that form a first open-ended, tapered slot co-aligned with an axis of propagation of the traveling wave signal, wherein the second tapered slot launcher includes a third member and a fourth member, the third member and the fourth member including spaced apart co-planar members that form a second open-ended, tapered slot co-aligned with an axis of propagation of the traveling wave signal, wherein the first open-ended, tapered slot is co-planar with the second open-ended, tapered slot, wherein the second slot launcher is stacked on the first slot launcher forming a three-dimensional open-ended, tapered slot array;

wherein the stacked slot launcher insert is at least partially deposited in the slot line signal converter channel such that the first open-ended, tapered slot and the second open-ended, tapered slot are perpendicular to the exterior plane of the slot-line signal converter, and the first traveling wave signal and second traveling wave signal are parallel to the exterior plane of the slot-line signal converter;

wherein the first open-ended, tapered slot has a first geometry to emit the first traveling wave signal having a first frequency;

wherein the second open-ended, tapered slot has a second geometry to emit the second traveling wave signal having a second frequency; and wherein the first and second frequencies are different.

3. The method of claim 2 further comprising, launching the closed waveguide mode signals into a waveguide connector operably and communicably coupled to the first tapered slot launcher.

4. The method of claim 2 further comprising generating the signals using a semiconductor die disposed in the semiconductor package.

5. The method of claim 2 wherein the first member communicably coupled to a second electrically conductive member forming the slot-line signal converter at a first location proximate the balun structure; and the second member communicably coupled to the second electrically conductive member forming the slot-line signal converter at a second location proximate the balun structure.

6. The method of claim 2 wherein converting the signals to a slot line signals, via a balun structure formed at least partially in the slot line signal converter comprises:

converting the signals to slot line signals via a slot-line signal converter that includes:

a first electrically conductive member including a balun structure having a first physical geometry; and a second electrically conductive member including a balun structure having a second physical geometry, the second electrically conductive member conductively coupled to the first electrically conductive member.

7. The method of claim 6 wherein converting the signals to slot line signals via a slot-line signal converter that includes a first electrically conductive member including a balun structure having a first physical geometry comprises:

converting the signals to slot line signals via a slot-line signal converter that includes a first electrically conductive member including a balun structure having a first physical geometry that includes a double-lobed balun structure that includes at least one of: double circular lobes; double rectangular lobes; double wedge-shaped lobes; or double hexagonal lobes.

8. The method of claim 7 wherein converting the signals to slot line signals via a slot-line signal converter that includes a second electrically conductive member including a balun structure having a second physical geometry comprises:

converting the signals to slot line signals via a slot-line signal converter that includes a second electrically conductive member including a balun structure having a second physical geometry that includes a double-lobed balun structure that includes at least one of: double circular lobes; double rectangular lobes; double wedge-shaped lobes; or double hexagonal lobes.

9. The method of claim 8 wherein converting the signals to slot line signals via a slot-line signal converter that includes: a first electrically conductive member including a balun structure having a first physical geometry; and a second electrically conductive member including a balun structure having a second physical geometry comprises:

converting the signals to slot line signals via a slot-line signal converter that includes: a first electrically conductive member including a balun structure having a first physical geometry; and a second electrically conductive member including a balun structure having a second physical geometry, the first physical geometry corresponding to the second physical geometry.

10. A microwave waveguide connector and slot launcher apparatus, comprising:

a slot line signal converter that includes:

a first electrically conductive member communicably coupleable to a semiconductor package;

a planar second electrically conductive member conductively coupled to the first electrically conductive member, at least a portion of the second electrically conductive member communicably coupleable to a waveguide member; and a balun structure to convert a signal to a slot-line signal;

wherein the slot line signal converter comprises a slot line signal converter channel that extends at least partially through the plane of the second electrically conductive member;

a stacked slot launcher insert comprising:

a first tapered slot launcher to emit a first traveling wave signal having an axis of propagation parallel to the plane of the second electrically conductive member, the first tapered slot launcher including a first member and a second member;

wherein the first member and the second member include spaced apart coplanar members that form a first open-ended, tapered slot co-aligned with the axis of propagation of the first traveling wave signal;

wherein the first member communicably couples to the second electrically conductive member at a first location proximate the balun structure;

wherein the second member communicably couples to the second electrically conductive member at a second location proximate the balun structure; and a second tapered slot launcher to emit a second traveling wave signal having an axis of propagation parallel to the first traveling wave signal, the second tapered slot launcher including a third member and a fourth member;

wherein the third member and the fourth member forming the second tapered slot launcher include spaced apart coplanar members that form a second open-ended, tapered slot co-aligned with the axis of propagation of the second traveling wave signal, wherein the first open-ended, tapered slot is co-planar with the second open-ended, tapered slot, wherein the second slot launcher is stacked on the first slot launcher forming a three-dimensional open-ended, tapered slot array;

wherein the stacked slot launcher insert is at least partially deposited in the slot line signal converter channel such that the first open-ended, tapered slot and the second open-ended, tapered slot are perpendicular to the plane of the second electrically conductive member, and the first traveling wave signal and second traveling wave signal are parallel to the plane of the second electrically conductive member;

wherein the first open-ended, tapered slot has a first geometry to emit the first traveling wave signal having a first frequency;

wherein the second open-ended, tapered slot has a second geometry to emit the second traveling wave signal having a second frequency; and wherein the first and second frequencies are different.

11. The apparatus of claim 1, wherein the slot-line signal converter further includes a second balun structure;

wherein the third member of the second tapered slot launcher communicably couples to the second electrically conductive member at a first location proximate the second balun structure; and wherein the fourth member of the second tapered slot launcher communicably couples to the second electrically conductive member at a second location proximate second balun structure.

12. The apparatus of claim 1 wherein:

the first electrically conductive member comprises a member patterned on the semiconductor package;

the second electrically conductive member comprises a member coupled to the first tapered slot launcher; and the first electrically conductive member is conductively coupleable to the second electrically conductive member.

13. The apparatus of claim 12 wherein the balun structure included in the slot-line signal converter comprises:

a first balun structure having a first physical geometry formed in the first electrically conductive member; and a second balun structure having a second physical geometry formed in the second electrically conductive member.

14. The apparatus of claim 13 wherein the first physical geometry comprises a double-lobed balun structure that includes at least one of: double circular lobes; double rectangular lobes; double wedge-shaped lobes; or double hexagonal lobes.

15. The apparatus of claim 13 wherein the second physical geometry comprises a double-lobed balun structure that includes at least one of: double circular lobes; double rectangular lobes; double wedge-shaped lobes; or double hexagonal lobes.

16. The apparatus of claim 13 wherein the second physical geometry corresponds to the first physical geometry.

17. The apparatus of claim 1 wherein the first tapered slot launcher further includes a waveguide connector to accommodate the operable coupling of an external waveguide;

wherein at least one of the first member or the second member operably couples to the waveguide connector.

18. The apparatus of claim 17 wherein the waveguide connector operably couples to at least a portion of the second electrically conductive member.

19. The apparatus of claim 1 wherein the first tapered slot launcher further comprises a waveguide connector that includes a slot formed in a terminal end of the waveguide connector, the slot to accommodate a slideable insertion of the substrate, wherein the waveguide connector operably couples to the first tapered slot launcher on the substrate and to at least the second electrically conductive member of the slot-line signal converter.

* * * * *